US011311084B2

(12) United States Patent
Munoz

(10) Patent No.: US 11,311,084 B2
(45) Date of Patent: Apr. 26, 2022

(54) MULTI-PURPOSE BAG AND METHOD FOR PACKING AND SELLING CLOTHES

(71) Applicant: ABIBOO Corp, Jersey City, NJ (US)

(72) Inventor: Alfredo Munoz, Jersey City, NJ (US)

( * ) Notice: Subject to any disclaimer, the term of this patent is extended or adjusted under 35 U.S.C. 154(b) by 0 days.

(21) Appl. No.: 16/285,252

(22) Filed: Feb. 26, 2019

(65) Prior Publication Data

US 2019/0223568 A1 Jul. 25, 2019

Related U.S. Application Data

(63) Continuation of application No. 15/454,255, filed on Mar. 9, 2017, now Pat. No. 10,321,744, which is a (Continued)

(51) Int. Cl.
*A45C 7/00* (2006.01)
*A45C 3/00* (2006.01)
(Continued)

(52) U.S. Cl.
CPC ..... *A45C 7/005* (2013.01); *A45C 3/004* (2013.01); *A45C 5/08* (2013.01); *A45C 5/14* (2013.01); *A45C 7/009* (2013.01); *A45C 7/0045* (2013.01); *A45C 13/03* (2013.01); *A45C 13/10* (2013.01); *A45C 13/262* (2013.01); *A45C 15/00* (2013.01);
(Continued)

(58) Field of Classification Search
CPC ..... A45C 7/005; A45C 3/004; A45C 5/08; A45C 5/14; A45C 7/0045; A45C 7/009; A45C 13/03; A45C 13/10; A45C 13/262; A45C 15/00; A45C 13/30; A45C 2013/026; A45C 2013/267; A45F 3/02; A45F 3/04; A45F 3/00
See application file for complete search history.

(56) References Cited

U.S. PATENT DOCUMENTS 1,454,388 A 5/1923 Lauren
1,561,242 A * 11/1925 Kaye ..... A45C 3/00 206/278
(Continued)

FOREIGN PATENT DOCUMENTS

CA 2719261 A1 4/2012
CN 2504990 Y 8/2002
(Continued)

OTHER PUBLICATIONS

The state intellectual property office of India. Response to application 2017/37036516 based on PCT/US201623882.
(Continued)

*Primary Examiner* — Tri M Mai

(57) ABSTRACT

The present invention generally relates to a travel bag or a packaging container. Specifically, embodiments of the present invention are directed toward a modular travel, garment bag or similar container system that can be customized based on the needs of the user. Furthermore, the various modules or segments of the bag may have different shapes and sizes so as to be adapted to carry items, with such modules or segments being combinable in varying arrangements to provide a flexibly configured bag that is suitable for a variety of uses. The present invention also relates to a packaging system for suits, blazers and jackets from garment, fashion and retail brands.

16 Claims, 29 Drawing Sheets

Related U.S. Application Data continuation of application No. 14/675,983, filed on Apr. 1, 2015, now Pat. No. 9,648,933.

(51) Int. Cl.

| | |
|---|---|
| ***A45C 5/08*** | (2006.01) |
| ***A45F 3/02*** | (2006.01) |
| ***A45C 5/14*** | (2006.01) |
| ***A45C 13/03*** | (2006.01) |
| ***A45C 13/10*** | (2006.01) |
| ***A45C 13/26*** | (2006.01) |
| ***A45C 15/00*** | (2006.01) |
| ***A45F 3/04*** | (2006.01) |
| ***A45C 13/30*** | (2006.01) |
| ***A45C 13/02*** | (2006.01) |
| ***A45F 3/00*** | (2006.01) |

(52) U.S. Cl.

CPC ..... *A45F 3/02* (2013.01); *A45F 3/04* (2013.01); *A45C 13/30* (2013.01); *A45C 2013/026* (2013.01); *A45C 2013/267* (2013.01); *A45F 3/00* (2013.01)

(56) References Cited

U.S. PATENT DOCUMENTS 1,730,898 A 10/1929 Percival
1,903,798 A 4/1933 Turner
2,107,997 A 2/1938 Horsley
2,362,807 A 11/1943 Dresner
2,383,389 A 8/1945 Illion
2,502,033 A 3/1950 Bohn
2,561,112 A * 7/1951 Hahn ..... B65D 77/02 206/278
2,661,570 A 12/1953 Corley
2,919,017 A 12/1959 Weber
3,014,516 A 12/1961 Mueller
3,057,464 A 10/1962 Baggott
3,061,057 A 10/1962 Miller
3,128,854 A 4/1964 Specht
3,391,839 A 7/1968 Gwinn et al.
3,480,059 A 11/1969 Schoening
3,512,621 A * 5/1970 Teetor ..... A45C 3/004 206/287
3,621,991 A * 11/1971 Richter ..... A47G 25/54 206/284
3,650,775 A 3/1972 Simon et al.
3,728,003 A 4/1973 Bohannon
3,944,032 A * 3/1976 Samhammer ..... A45C 5/06 206/292
4,081,061 A * 3/1978 Tucker ..... A45C 3/00 190/108
4,170,282 A 10/1979 Chwartzstein
4,290,467 A 9/1981 Schmidt
4,361,947 A 12/1982 Arnaud
4,380,290 A 4/1983 Luebke
4,424,841 A 1/1984 Smith
4,505,506 A 3/1985 Picozza
4,596,340 A 6/1986 Luther
4,693,368 A 9/1987 King et al.
4,887,751 A 12/1989 Lehman
4,890,873 A 1/1990 Prada et al.
4,913,252 A 4/1990 Bartley et al.
5,005,743 A 4/1991 Ramsay
5,076,428 A 12/1991 Shaw
5,263,584 A 11/1993 Sevey
5,307,908 A 5/1994 Shyr et al.
5,316,096 A 5/1994 Good
5,330,026 A 7/1994 Hsu et al.
5,356,024 A 10/1994 Ho et al.
5,431,263 A 6/1995 Nordstrom
5,464,113 A 11/1995 Ho et al.
5,522,943 A 6/1996 Spencer et al.
5,544,781 A 8/1996 Mattesky
5,547,052 A 8/1996 Latshaw
5,551,562 A 9/1996 Beretta
5,624,026 A 4/1997 Chernoff
5,829,591 A 11/1998 Lyons
5,887,711 A * 3/1999 McAuliffe ..... A45C 3/004 206/292
5,964,741 A 10/1999 Moder et al.
6,161,692 A 12/2000 Lizarraga
6,220,411 B1 4/2001 Scicluna et al.
6,434,032 B1 8/2002 Romano
D462,169 S 9/2002 Giovanni
6,450,333 B1 9/2002 McClenahan
6,502,656 B2 1/2003 Weiss et al.
6,513,692 B1 2/2003 Forgosh et al.
D476,151 S 6/2003 Peterson
6,595,356 B1 7/2003 Homoly
6,612,453 B2 9/2003 Joo-Tai
6,742,635 B2 6/2004 Hirshberg
6,926,129 B2 8/2005 Hoberman
6,975,221 B2 12/2005 Monck
7,007,322 B2 3/2006 Alane
7,084,357 B2 8/2006 Roberts et al.
7,121,401 B1 10/2006 Sinha
7,358,449 B2 4/2008 Hannon
7,394,165 B2 7/2008 Schiller
7,398,868 B2 7/2008 Morszeck
7,416,066 B2 8/2008 Chernoff
7,422,476 B2 9/2008 Marmaropoulos et al.
7,506,778 B2 3/2009 DaSilva et al.
D589,750 S 4/2009 Liu et al.
D589,751 S 4/2009 Liu et al.
7,557,705 B2 7/2009 Oas
7,593,222 B2 9/2009 Zbikowski
7,600,620 B2 10/2009 Hammond
7,604,102 B2 10/2009 Albritton
7,618,260 B2 11/2009 Daniel et al.
7,677,389 B2 * 3/2010 Czopor, Jr ..... B65D 51/242 206/340
7,954,610 B2 6/2011 Dayton et al.
7,976,088 B1 7/2011 Diciolla
8,067,860 B2 11/2011 Hoffmann et al.
8,118,146 B2 2/2012 Shalgi
8,287,020 B1 10/2012 Guerin
8,573,373 B2 11/2013 Rothschild et al.
8,884,583 B2 11/2014 Edwards
8,910,813 B1 12/2014 Barre et al.
8,988,038 B2 3/2015 Samuel
9,078,501 B2 * 7/2015 Johnson ..... A45C 13/02
10,136,712 B2 * 11/2018 Taylor-Phillips .... A45C 11/008
2002/0023912 A1 2/2002 McGee et al.
2004/0085043 A1 5/2004 Germagian et al.
2004/0129469 A1 7/2004 Kader
2005/0000964 A1 1/2005 Morszeck et al.
2005/0098402 A1 5/2005 Cohen
2005/0140331 A1 6/2005 McQuade
2006/0032687 A1 2/2006 Park et al.
2006/0196708 A1 9/2006 Keech et al.
2006/0266563 A1 11/2006 Kaplan
2007/0029218 A1 2/2007 Picot et al.
2007/0034424 A1 2/2007 Snowden et al.
2007/0131462 A1 6/2007 Hemsley
2008/0029153 A1 2/2008 Margalit
2008/0087513 A1 4/2008 Majeau
2009/0139990 A1 6/2009 Bailis
2009/0159597 A1 * 6/2009 Alexander ..... E05G 1/024 220/520
2009/0205235 A1 10/2009 Scicluna
2009/0306485 A1 12/2009 Bell
2010/0018088 A1 1/2010 Rajpal
2010/0231161 A1 9/2010 Brown
2011/0011761 A1 1/2011 Enmon
2011/0050162 A1 3/2011 FallHowe
2011/0073425 A1 3/2011 Siu et al.
2012/0006719 A1 1/2012 Celona et al.
2012/0042996 A1 2/2012 Glynn
2012/0074004 A1 3/2012 Andochick
2012/0087601 A1 4/2012 Nathan et al.
2012/0111679 A1 5/2012 Van Den Biggelaar et al.

(56) References Cited

U.S. PATENT DOCUMENTS

| | | | | |
|---|---|---|---|---|
| 2012/0152677 | A1 | 6/2012 | Lu | |
| 2012/0125496 | A1 | 10/2012 | Hedaya | |
| 2012/0255824 | A1 | 10/2012 | Schnell et al. | |
| 2012/0255879 | A1 | 10/2012 | Gillespie | |
| 2012/0262117 | A1 | 10/2012 | Ferber et al. | |
| 2013/0032443 | A1 | 2/2013 | Soedomo | |
| 2013/0098721 | A1 | 4/2013 | Lai | |
| 2013/0126286 | A1 | 5/2013 | Chehebar | |
| 2013/0175130 | A1 | 7/2013 | Liang | |
| 2013/0192942 | A1 | 8/2013 | Willi | |
| 2013/0221898 | A1 | 8/2013 | Frost | |
| 2013/0233661 | A1 | 9/2013 | Scott | |
| 2013/0248309 | A1 | 9/2013 | Lein et al. | |
| 2013/0264162 | A1 | 10/2013 | Kogelnik | |
| 2013/0269844 | A1 | 10/2013 | Gyuran | |
| 2013/0271063 | A1 | 10/2013 | Wilson | |
| 2013/0308428 | A1 | 11/2013 | Westcott | |
| 2013/0335003 | A1 | 12/2013 | Buhler et al. | |
| 2014/0000771 | A1 | 1/2014 | Sherman et al. | |
| 2014/0041978 | A1 | 2/2014 | Chang | |
| 2014/0061258 | A1 | 3/2014 | Van der Laan | |
| 2014/0076679 | A1 | 3/2014 | Hughes | |
| 2014/0158564 | A1 | 6/2014 | Blasingame | |
| 2014/0327401 | A1 | 11/2014 | Pickens et al. | |
| 2014/0337621 | A1 | 11/2014 | Nakhimov | |
| 2014/0353104 | A1 | 12/2014 | Sheikh et al. | |
| 2014/0369628 | A1 | 12/2014 | Tzortzis | |
| 2015/0021132 | A1 | 1/2015 | Sijmons | |
| 2015/0027834 | A1 | 1/2015 | Kogelnik | |
| 2015/0027836 | A1 | 1/2015 | Zhou | |
| 2015/0040622 | A1 | 2/2015 | Meersschaert et al. | |
| 2015/0055278 | A1 | 2/2015 | Baschnagel | |
| 2015/0084592 | A1 | 3/2015 | Pickens et al. | |
| 2015/0084596 | A1 | 3/2015 | Pickens et al. | |
| 2015/0144237 | A1 | 5/2015 | Salibri | |
| 2017/0354222 | A1* | 12/2017 | Wolfe ..... | A45C 3/00 |

FOREIGN PATENT DOCUMENTS

| | | | |
|---|---|---|---|
| CN | 201451944 | U | 5/2010 |
| CN | 201640863 | U | 11/2010 |
| CN | 203524049 | U | 4/2014 |
| CN | 104082929 | A | 10/2014 |
| CN | 204426982 | U | 12/2014 |
| DE | 8801462 | | 7/1988 |
| DE | 9406151 | | 8/1994 |
| DE | 102010025056 | A1 | 12/2011 |
| DE | 202014004128 | U1 | 7/2014 |
| EP | 2080445 | A2 | 7/2009 |
| GB | 2 312 371 | A | 10/1997 |
| GB | 2493218 | | 1/2013 |
| JP | H0532285 | | 2/1993 |
| JP | 2004089643 | A | 3/2004 |
| SE | O 201 412 | L | 11/2003 |
| SE | 525191 | C2 | 12/2004 |
| TW | M410495 | U | 9/2011 |
| WO | WO 1996/31140 | A1 | 4/1994 |
| WO | WO 2007/014804 | A1 | 2/2007 |
| WO | WO 2007/073590 | A1 | 7/2007 |
| WO | WO 2008/006354 | A2 | 1/2008 |
| WO | WO 2009/002499 | A9 | 12/2008 |
| WO | WO 2009/045542 | A1 | 4/2009 |
| WO | WO 2010/135402 | A2 | 11/2010 |
| WO | WO 2011112655 | A1 | 9/2011 |
| WO | WO 2012/046177 | A1 | 4/2012 |
| WO | WO2012135576 | A2 | 10/2012 |
| WO | WO 2013/126459 | A2 | 8/2013 |
| WO | PCT/IL2013/050878 | | 10/2013 |
| WO | WO 2014/073971 | A1 | 5/2014 |
| WO | WO 2014/166665 | A1 | 10/2014 |

OTHER PUBLICATIONS

The state intellectual property office of P.R.China. Response to application 201680012116.4 based on PCT/US201623882, dated Aug. 3, 2020.

The state intellectual property office of P.R.China. Response to application 201680012116.4 based on PCT/US201623882, dated Mar. 2, 2021.

Trevor Mogg, "https://www.digitaltrends.com/home/trunkster-suitcase/". Date: Nov. 18, 2014.

Trunkster, "https://www.kickstarter.com/projects/trunkster/trunkster-zipperless-luggage-with-gps-battery-scal/description". Date: Nov. 18, 2014.

Aaron Souppouris, https://wwwengadget.com/2014/10/20/bluesmart-connected-luggage-indiegogo-campaign/ Date: Oct. 20, 2014.

Natasha Lomas, "https://techcrunch.com/2014/11/17/bluesmart-indiegogo/". Date: Nov. 17, 2014.

International search report and written opinion for International (PCT) Patent Application No. PCT/US16/23882, dated Jul. 26, 2016, 13 pages.

Supplementary European Search Report EP 16773772.5 to PCT/US201623882.

The state intellectual property office of P.R.China. Response to application 2016800121164 based on PCT/US201623882.

* cited by examiner 2117
2133

2132
2110
2211
2217
2212

2210
2312
2318

2310
2317
2333

2410
131
2517
2532

2510
2617

2610
2721

2710
2822

2810

FIG. 17
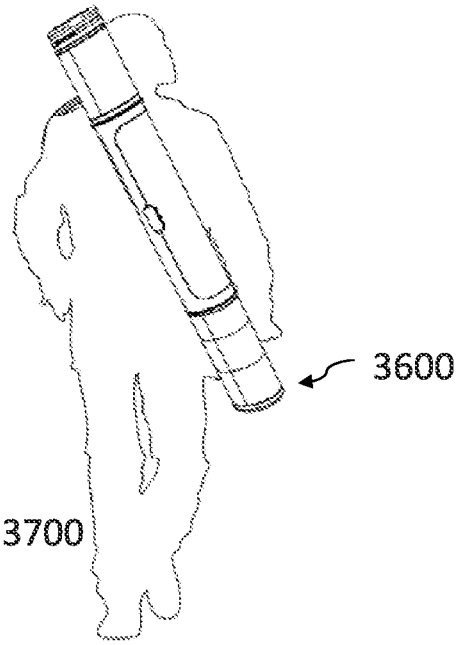
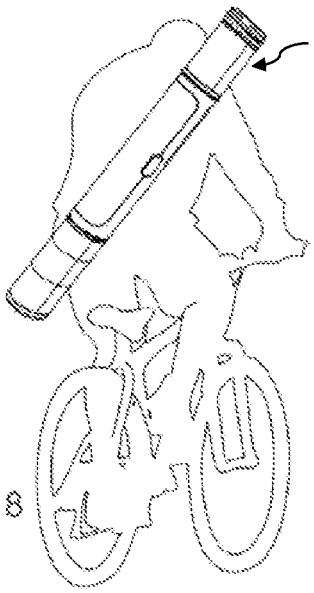
FIG. 18

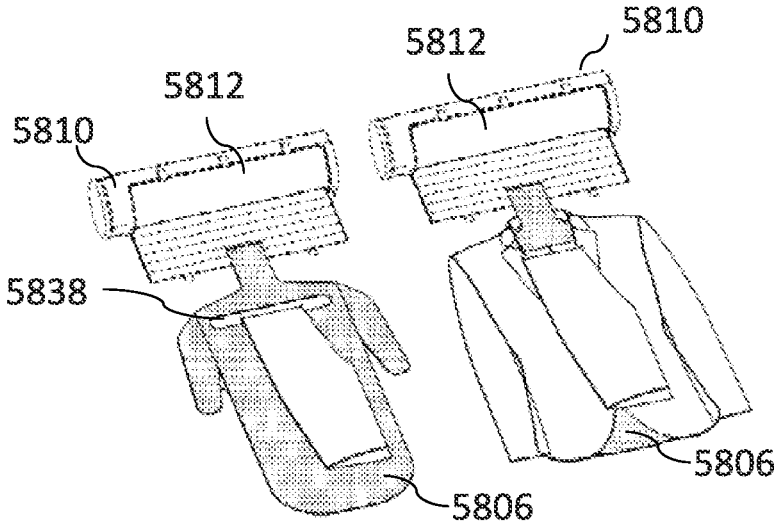
FIG. 31A
FIG. 31B
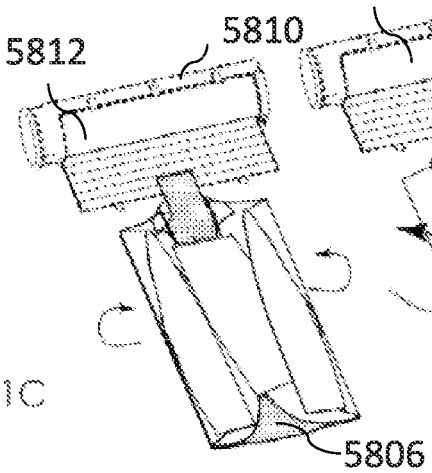
FIG. 31C
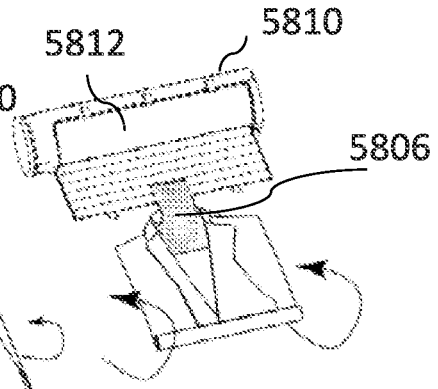
FIG. 31D

FIG. 34A
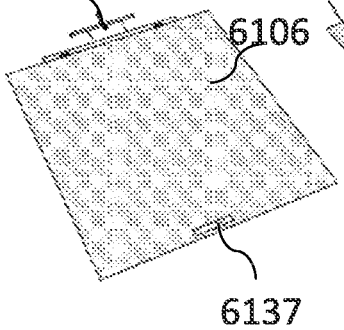
FIG. 34B
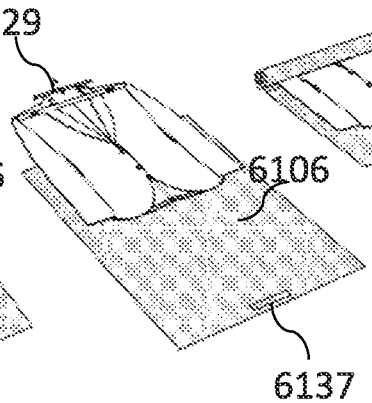
FIG. 34C
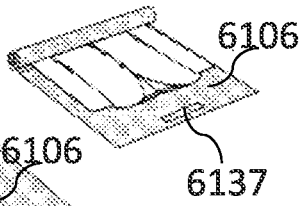
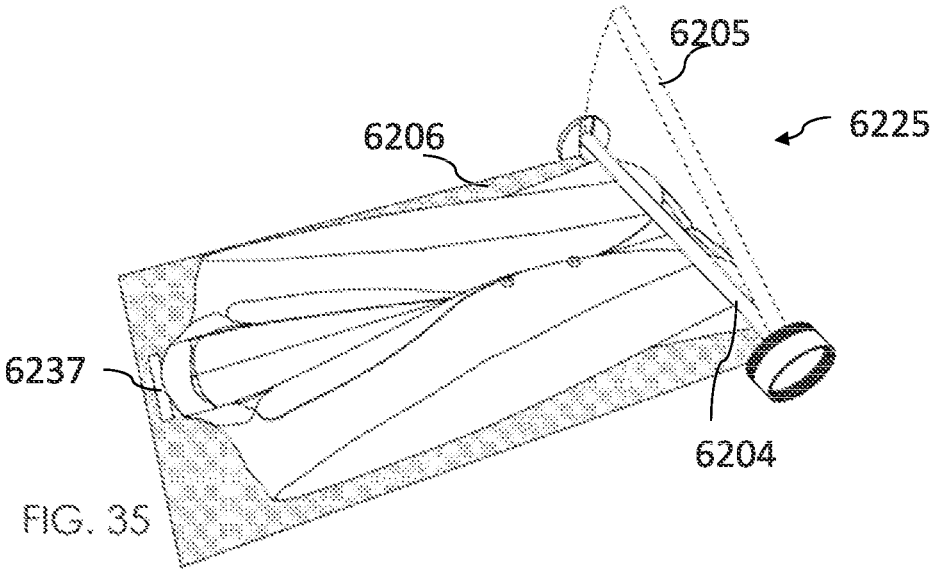
FIG. 35

MULTI-PURPOSE BAG AND METHOD FOR PACKING AND SELLING CLOTHES

This application is a continuation of U.S. patent application Ser. No. 15/454,255, filed Mar. 9, 2017, which is a continuation of U.S. patent application Ser. No. 14/675,983, filed Apr. 1, 2015, the entirety of which is incorporated by reference herein.

FIELD OF THE INVENTION

The present invention generally relates to a travel bag or a packaging container. Specifically, embodiments of the present invention are directed toward a modular travel, garment bag or similar container system that can be customized based on the needs of the user. Furthermore, the various modules or segments of the bag may have different shapes and sizes so as to be adapted to carry items, with such modules or segments being combinable in varying arrangements to provide a flexibly configured bag that is suitable for a variety of uses. The present invention also relates to a packaging system for suits, blazers and jackets from garment, fashion and retail brands.

BACKGROUND OF THE INVENTION

Traditional luggage and baggage solutions lack the flexibility that is important for a modern traveler. In particular, traditional luggage and baggage designs have a fixed size that cannot be adapted to fit the needs of a traveler for a given trip or activity, and in many cases they require a traveler to check a bag rather than keep the bag as carry-on item. Additionally, traditional luggage typically requires a traveler to use one hand to carry, push, or pull the bag, which can be a detriment to the modern traveler that needs both hands free for tasks such as eating, drinking, reading, or using a mobile electronic device. Furthermore, currently available luggage and baggage solutions do not effectively incorporate features that are important to the modern traveler, most notably a battery charger, GPS, speakers or similar electrical or power sources, which have become essential with the ever increasing reliance on mobile electronics.

Also, the traditional designs of certain types of luggage do not effectively achieve the intended function of the bag. For example, traditional garment bags require that the clothing placed within the bag to be folded which results in wrinkles. Moreover the shape of the traditional garment bag is such that it is bulky and awkward to carry. In particular, the thin, flat shape of traditional garment bags makes them unstable to wind forces and difficult to carry in crowds, which further exacerbates the garment bags discomfort. Additionally, the bulk of traditional garment bags often mean that a traveler cannot keep the garment bag as a carry-on item, thereby defeating the purpose of keeping the garment bag with the traveler to help ensure the secure and wrinkle-free transport of the garments therein. Although there are certain rolling garment bag solutions available, those solutions also suffer from similar limitations due to the large diameter and bulk, which make such bags uncomfortable to carry, especially on the back. Additionally, the flexible nature of many currently available garment bags limits the ability for such garment bags to provide protection to the items being carried. Finally, currently available rolled garment bags do not provide a rolling device with a means to firmly secure a garment in order to start the rolling of the garment.

Therefore, there is a need in the art for a multipurpose modular bag or container that can be taken as carry-on bag, is adapted to fit the specific needs of a traveler on a given trip, provides different levels of protections to items retained within the bag, avoids wrinkles and creases in the garments, allows for hands free carrying and can also be used as a packaging for suits, jackets and blazer while selling such garments. These and other features and advantages of the present invention will be explained and will become obvious to one skilled in the art through the summary of the invention that follows.

SUMMARY OF THE INVENTION

Accordingly, it is an object of the present invention to provide a modular baggage and packaging solution where some of the modules can be replaced by others due to the connections among them, allowing a highly flexible solution as the bag can be adapted to fit the needs of a particular trip, activity or individual traveler in particular, the present invention is a modular travel bag that incorporates features of a garment bag by providing an embodiment that allows for a garment to be rolled and stored for transport, thereby reducing the occurrence of wrinkles and protecting the garment from the external elements.

According to some embodiments of the present invention, a modular travel bag comprising a first bag module comprising a longitudinal axis defined by a first longitudinal end point at one end of the longitudinal axis and by a second longitudinal end point at the opposite end of the longitudinal axis, a shell that is elongated along the longitudinal axis of the bag module, a storage cavity formed inside of the shell, one or more access points that provide access to the storage cavity, and one or more module connection members, and a second bag module comprising a shell, a storage cavity formed inside of the shell, one or more access points that provide access to the storage cavity, and one or more module connection members, wherein a detachable connection between one of the module connection members on the first bag module and one of the module connection members on the second bag module will cause the second bag module to become aligned with and connected to one of the longitudinal end points of the first bag module.

According to some embodiments of the present invention, the first bag module is configured to have the second bag module aligned at either end of the longitudinal axis of the first bag module According to some embodiments of the present invention, the first bag module is a garment bag module.

According to some embodiments of the present invention, garment bag module comprises a garment rolling device comprising a garment rolling sheet connected to a clipping device formed by two garment rolling guide bars that are separable to provide a clipping effect so that a garment may be secured between the garment rolling guide bars, wherein the garment rolling device is inserted into the garment bag module at one of the access points of the first bag module.

According to some embodiments of the present invention, the garment bag module comprises a garment rolling device comprising a first hanger bar, a second hanger bar attached to the first hanger bar by a connector sheet, one or more clipping elements on the first hanger bar, and a hook, wherein the garment rolling device is inserted into the garment bag module at one of the access points of the first bag module.

According to some embodiments of the present invention, the access point is formed in the shell.

According to some embodiments of the present invention, the access point is further comprised on an access door that covers the access point formed in the shell.

According to some embodiments of the present invention, the access point is a hinge that in the shell that is openable to provide an access point.

According to some embodiments of the present invention, the detachable connection is an indirect connection formed by a module linking connector.

According to some embodiments of the present invention, the detachable connection is formed by securely abutting the second bag module to the first bag module such that the second bag module is extensive with one of the longitudinal end points of the first bag module.

According to some embodiments of the present invention, the one of the bag modules is a telescoping bag module or an accordion-like bag module.

According to some embodiments of the present invention, any of the one or more module connectors of each of bag modules may be any module connector selected from a group of module connectors consisting of male-female connectors, zipper connectors, clip connectors, latches, buckle connectors, magnetic connectors, electronic connectors, rubber connectors, threaded connectors, vacuum connections, friction-fit connectors, clamping connectors, snap-fit connectors, and springs.

According to some embodiments of the present invention, the modular bag further comprises one or more accessories selected from the group of accessories consisting of carrying elements, wheels, and hanger elements.

According to some embodiments of the present invention, the carrying elements are selected from the group of carrying elements consisting of hand holds, cords, grips, bandoliers, shoulder straps, backpack straps, hooks, and retractable handles.

According to some embodiments of the present invention, the modular bag further comprises one or more supplemental storage containers that are attached to a side wall of one of the bag modules.

According to some embodiments of the present invention, a modular travel bag comprising a first bag module comprising a longitudinal axis defined by a first longitudinal end point at one end of the longitudinal axis and by a second longitudinal end point at the opposite end of the longitudinal axis, a shell that is elongated along the longitudinal axis of the bag module, a storage cavity formed inside of the shell, one or more access points that provide access to the storage cavity, and one or more module connectors, and a second bag module comprising a main body portion and one or more module connectors, wherein the main body portion is defined by a first end and by a second end, wherein a first detachable connection between one of the module connectors on the first bag module and one of the module connectors on the second bag module will cause one of the ends of the second bag module to become aligned with and connected to one of the longitudinal end points of the first bag module and the second bag module is configured to align with the first bag module from either of the ends of the second bag module.

According to some embodiments of the present invention, the modular bag further comprises a third bag module with one or more connectors, wherein a second detachable connection between one of the module connectors on the second bag module and one of the module connectors on the third bag module will cause the third bag module to become aligned with and connected to the end of the second bag module that is opposite the first detachable connection.

According to some embodiments of the present invention, the second bag module is an electronic device module selected from a group of electronic devices modules consisting of a speaker for connecting to external or internal audio device, media player, geolocation device, digital display screen, electronic ink display, a power source, or battery charger.

According to some embodiments of the present invention, a modular travel bag comprising a first bag module comprising a main body portion defined by a first end at one end of the main body portion and by a second end at the opposite end of the main body portion, a storage area formed inside of the main body portion, one or more access points that provide access to the storage area, and one or more module connectors, and a second bag module comprising a main body portion and one or more module connectors, wherein the main body portion is defined by a first end and by a second end, wherein a main body portion of one of the bag modules is formed by rolling one or more sheets of material to create a substantially tubular bag module, wherein a detachable connection between one of the module connectors on the first bag module and one of the module connectors on the second bag module will cause one of the ends of the second bag module to become aligned with and connected to one of the end of the first bag module.

According to some embodiments of the present invention, one of the bag modules is a garment bag module.

The foregoing summary of the present invention should not be construed to limit the scope of the invention. It should be understood and obvious to one skilled in the art that the embodiments of the invention thus described may be further modified without departing from the spirit and scope of the invention.

BRIEF DESCRIPTION OF THE DRAWINGS

FIG. 9 illustrates various shaped bag modules, in accordance with an embodiment of the present invention;

FIG. 17 is an illustration of a modular bag being carried on a shoulder of a person, in accordance with an embodiment of the present invention;

FIG. 18 is an illustration of modular bag being carried across the back of a cyclist, in accordance with an embodiment of the present invention;

FIGS. 31A-D is an illustration of a garment rolling device consisting primarily of a shaped garment rolling sheet, in accordance with an embodiment of the present invention;

FIGS. 34A-C is an illustration of a garment rolling device with a hanger element, in accordance with an embodiment of the present invention;

FIG. 35 is an illustration of a garment rolling device with a garment rolling sheet attached to two lateral tabs and two bars creating a clipping devise as a rolling guide, in accordance with an embodiment of the present invention;

FIG. 40 is a process flow for an exemplary method for packaging articles of clothing in a modular travel container, in accordance with an embodiment of the present invention;

DETAILED DESCRIPTION

Figure 1:
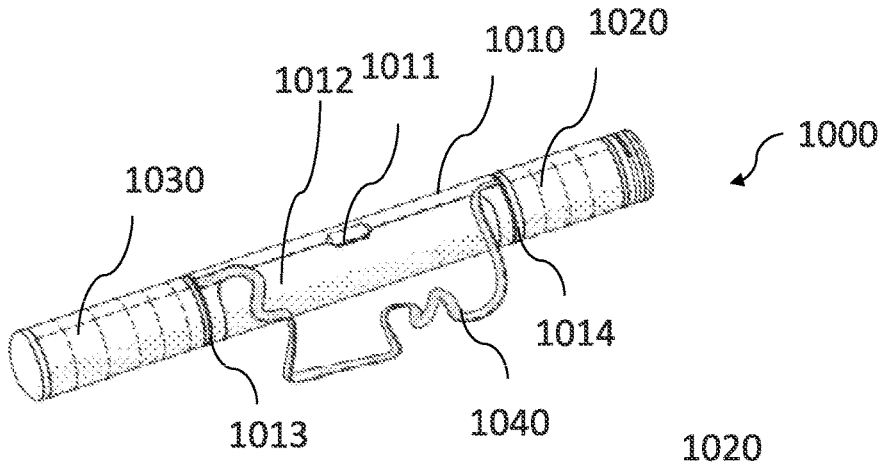
FIG. 1 is a perspective view of a modular bag, in accordance with an embodiment of the present invention.

The present invention generally relates to a travel bag or a packaging container. Specifically, embodiments of the present invention are directed toward a modular travel, garment bag or similar container system that can be customized based on the needs of the user. Furthermore, the various modules or segments of the bag may have different shapes and sizes so as to be adapted to carry items, with such modules or segments being combinable in varying arrangements to provide a flexibly configured bag that is suitable for a variety of uses. The present invention also relates to a packaging system for suits, blazers and jackets from garment, fashion and retail brands.

According to an embodiment of the present invention, a modular travel bag that can be assembled into a customized configuration based on the requirements of given trip or activity. In one embodiment, the modular travel bag may be comprised of various bag modules, each of which are comprised of a main body portion with a first end a second end, one or more access points on the main body portion, and one or more module connectors. In alternate embodiments, the modular travel bag may include fewer or additional components and features depending upon the intended use of the bag. Optional components include, but are not limited to (i) a garment rolling guide bar or garment rolling sheet, (ii) straps, handles, and other carrying elements; (iii) wheels, rollers, and similar means for carrying, reshaping or moving the modular bag; (iv) hangers, hooks, and similar elements for hanging the bag and; (v) supplemental storage compartments that are formed on or attached to the main body portion of the bag module (vi) electronic devices; and (vii) power source devices. One of ordinary skill in the art would appreciate that numerous possible components and configurations for a modular bag, and embodiments of the present invention are contemplated for use with any such component or configuration.

According to some embodiments of the present invention, the modular travel bag primarily comprises a variety of bag modules. In one embodiment, the various bag modules could be combined in any suitable fashion or each bag module could be used individually. In one embodiment, the modular nature of the bag allows a user to assemble a customized baggage solution to precisely meet the needs of a user. As an illustrative example, the modular bag could be assembled into a configuration that allows it to be used as carry-on baggage in an airplane. In one embodiment, a bag module will have a diameter of between 7 cm and 36 cm, with a diameter of 12.5 cm that provides a balance between wrinkle-resistance and ease of transport. In some embodiments, a bag module may be of a continuous diameter, while in other embodiments a bag module may vary in diameter. One of ordinary skill in the art would appreciate that each bag module could be configured in any suitable size range without departing from the spirit and scope of the invention.

According to some embodiments of the present invention, the modules of the modular bag are connected in an end-to-end arrangement. In one embodiment, the primary axis of the modular bag is elongated by connecting an end of a first bag module to an end of second bag module such that the total length of the modular bag is greater than the length of either of the first and second bag modules alone. In this embodiment, the connection of an end of a first bag module to an end of second bag module may result in an assembled modular bag with any variety of shapes, including but not limited to straight, curved, polygonal, fractal, or irregular lines.

According to some embodiments of the present invention, a bag module may be defined by a shell wall that forms the exterior of said bag module. The shell wall may also be referred to as a module shell wall or the exterior wall of the module. In one embodiment, a storage cavity is formed within and defined by the shell wall. In this embodiment, the shell wall terminates at a first end point on one end of the bag module and at a second end point on the opposite end of the bag module. In this embodiment, there may be any number of openings formed in the shell wall including, but not limited to, an opening at each end the shell, an opening at only one end of the shell, or one or more openings on the side wall of the shell. In some embodiments, a bag module may be completely solid and function merely as a connector. In other embodiments, a bag module may be solid and function as an electrical, digital or power source device.

According to some embodiments of the present invention, a bag module may be formed from a module wall sheet where the bag module is created by rolling one or more sheets of material to create a stable tube-like section. The module wall sheet may also be referred to as a rollable module wall. In one embodiment, a storage area is located on the surface the module wall sheet that will become the inner side of the bag module once the module is rolled into form. In an alternate embodiment, the rolling of the module wall sheet creates a storage cavity that is on the inside of the formed tubular garment bag. In some embodiments, the tubular bag module terminates at a first end point on one end of the bag module and at a second end point on the opposite end of the bag module. In some embodiments the module wall sheet is flexible to permit rolling and is continuously bendable in at least the primary rolling direction. In some embodiments, the module wall sheet may also include a plurality of bending lines arranged perpendicularly to the primary rolling direction that provide for a module wall sheet with a segmented construction. In some embodiments, the module wall sheet can be automatically rolled-up or stretched, in a fashion that is similar to a projection screen or window shade. In some embodiments, the module wall sheet may include additional sheets of material. In one embodiment, a tubular bag module could be used as a garment bag module. One of ordinary skill in the art would appreciate there are many possible configurations for a tubular bag module, and embodiments of the present invention are contemplated for use with any such configuration.

According to some embodiments of the present invention, each of the bag modules may be formed in any suitable shape. In one embodiment, each of the bag modules may be configured as a generally tubular design, with the tubular design being in any suitable shape including, but not limited to, circular, oval, elliptical, triangular, square, hexagonal, or similar shape. In another embodiment, a bag module may have a non-tubular design, such as a substantially conical or cube design. In this embodiment, each bag module may be rigid, semi-rigid, soft-sided, flexible, or inflatable, or any combination thereof. In some embodiments, a bag module may vary in cross-section along its length. In some embodiments, certain bag modules may have a cross-section that is determined by internal or external pressures, such as inflatable portions or from pressure from garments inside of the module. One of ordinary skill in the art would appreciate that each bag module could be configured in any suitable shape without departing from the spirit and scope of the invention.

According to some embodiments of the present invention, bag modules may be configured with a variety of visual appearances. For example, bag modules may be opaque with any type of colored or texture. Bag modules may also be transparent or translucent with any type of texture. In some embodiments, a given bag module could use different materials, finishes or opacities on the outside and inside surfaces of the module or throughout different parts of the module.

According to some embodiments of the present invention, each of the bag modules may be fabricated from a variety of lightweight materials. In one embodiment, a bag module may be fabricated using any number of materials including, but not limited to, carbon fiber, nylon, fiberglass, polyester, polymers, plastics, leather, graphite, cardboard, foam, cotton, and other fabrics, thermo-formable materials, shape-memory alloys, aramid fibers (e.g. Nomex® or Kevlar®) and aluminum and other lightweight metals, or any suitable combination thereof. A bag module may be opaque, translucent, transparent, or colored. In some embodiments, different treatments or finish materials may be applied to the surface of the bag module, including, but not limited to treatments for waterproofing and stain resistance. In some embodiments the bag module may be an open-mesh that provides rigidity and protection to any secondary removable bags located inside such modules. In some embodiments, the interior of a bag module may be configured with different finishes or materials than the exterior to provide a more finished look or to add, for example, padding to protect items that are placed in the bag module. In some embodiments, the structure of a bag module may include a framework that supports lighter weight materials that form the majority of the bag module. One of ordinary skill in the art would appreciate that there are many suitable materials that could be used to fabricate a bag module, and embodiments of the present invention are contemplated for use with any such material.

According to some embodiments of the present invention, one or more access points may be located in or on the main body portion of a bag module. In one embodiment, an access point formed at either end of the bag module, the side wall of the main body portion of the bag module, or any combination thereof is provided. In some embodiments, the access point may be formed as an opening at both ends of the bag module, creating a tube-like bag module. In some embodiments, the access point may be formed only at one end of the bag module, creating an open-top canister or cylinder. In some embodiments, the access point may be formed in a side wall of the main body portion of the bag module. In such an embodiment, the access point may further include an access door that covers the access point, wherein the access door may be hinged, partially detachable, or completely detachable from the side wall to provide entry to the access point. In some embodiments, the access point may be provided by a longitudinal body hinge that extends along the length of the side wall of the bag module, thereby allowing the bag module to be opened up to provide an access point along the entire length of the bag module. In some embodiments, the access point may be provided by unrolling a module wall sheet that creates the bag module, thereby providing an access point to the bag module. In this embodiment, the access point may include an access point securing device to cover, latch, or otherwise secure the access point in a closed position. One of ordinary skill in the art would appreciate that there are many ways in which to form an access point in a bag module, and embodiments of the present invention are contemplated for use with any such access points.

According to some embodiments of the present invention, the access point may be secured or covered. In one embodiment, the access point is secured with a cap, latch, strap, buckle, clip, zipper, magnet, or any similar device that could be used to cover or secure an access point. As an illustrative example, an end cap might be used to close off a bag module that has an access point at the end of the bag module, while a latch may be used to secure the access door to an access point formed in the side wall of the bag module. In some embodiments, the access point securing device may incorporate security measures that include, but are not limited to, biometric locks, digital, electronic, magnetic or mechanical password locks, and near-field communications where a user's electronic device is used to authorize access. One of ordinary skill in the art would appreciate that there are a variety of suitable access point securing device that could be used to secure an access point of a bag module, and embodiments of the present invention are contemplated for use with any such access point securing device.

According to some embodiments of the present invention, a first bag module may be reversibly connectable to a second bag module via a module connector. In one embodiment, the module connectors may facilitate the detachable connection and combination of different bag modules in varying arrangements based upon the needs of the user. In this embodiment, the module connectors could be any suitable connector including, but not limited to, zippers, male-female connectors, magnets, pressure or friction fit connectors, snap-fit connectors, clip connectors, latches, buckle connectors, electronic connectors, rubber connectors, threaded connectors, vacuum connections, clamping connectors, springs threaded connectors, or any similar corresponding pair of connectors.

In some embodiments, the module connectors may be directly incorporated into the bag module. As an illustrative example, the module connectors may be formed as a part of the main body section of the bag module as snap-fit connector, male-female, magnet or other connector embedded in the bag module. In some embodiments, the module connector may be a separate element that facilitates a connection between two bag modules by first attaching to one bag module and then attaching to a second bag module, with separate elements being rigid, semi-rigid or flexible. As an illustrative example, the module connector may be a connector ring or adapter that provides a structural link between two bag modules that might not otherwise be connectable. Such a module connector could be useful to ensure compatibility of connection between bag modules that have integrated connectors that would not otherwise be compatible with each other. As further illustrative example, the module connectors may be an elongated rubber or leather strap that connects the modules. In one embodiment, the module connectors will be formed on or configured to attach to an end point of the bag module. In an alternate embodiment, the module connection may be formed on or configured to attach to the side wall of the bag module. One of ordinary skill in the art would appreciate that there are many suitable designs and arrangements for a module connector, and embodiments of the present invention are contemplated for use with any such design.

According to some embodiments of the present invention, each bag module of the modular bag may function independently of any other bag module. In one embodiment, each bag module may connect with a module securing element that is separate from the module connector. In this embodiment, a module securing element, such a securing strap, could be used to secure separate modules together in stacked, side-by-side, and other configurations that do not rely on an end-to-end connection between bag modules.

According to some embodiments of the present invention a two bag module may connect to each other via a detachable connection. In one embodiment, the detachable connection created between the connector of one bag module and the connector of another bag module will make the second bag module become aligned with and connected in line with the longitudinal axis the first bag module. In alternate embodiments, the detachable connection could be used to align and connect the second bag module with any suitable axis of the first bag module. In some embodiments, the detachable connection is an indirect connection formed by a module linking connector. The module linking connector may be a linking bar, solid connector unit, or another bag module that facilitates a connection between two bag modules. The module linking connector may be straight, curved, angled, irregularly shaped, or of any shape required to facilitate the connection. In some embodiments, the detachable connection may be formed by securely abutting a second bag module against a first bag module such that the second bag module is extensive with the primary axis of the first bag module. One of ordinary skill in the art would appreciate that there are many possible arrangements and configurations for a detachable connection, and embodiments of the present invention are contemplated for use with any such arrangement or configuration.

According to some embodiments of the present invention, the modular travel bag may incorporate a telescoping functionality to collapse one or more bag modules into a more compact form factor. In one embodiment, one or more of the bag modules may be configured with a telescoping function. In one embodiment, the telescoping function would allow multiple separate bag modules to collapse or slide inside of each other to reduce the number of bag modules or the overall size of the entire modular bag. As an illustrative example, a modular bag with three separate bag modules may be collapsible into the size of single bag module. In another embodiment, the telescoping functionality could be used to provide a modular bag or single bag module that is adaptable in size. One of ordinary skill in the art would appreciate that there are a number of benefits to incorporating a telescoping functionality into the modular bag or bag modules, and embodiments of the present invention may be configured to take advantage of any such benefit.

According to some embodiments of the present invention, each bag module may be configured to collapse into a smaller form factor. In one embodiment, an individual bag module may be configured with a shell or main body side walls that are telescoping. In another embodiment, an individual bag may be configured with a shell or main body side wall that has an accordion-like shell or main body side walls that permits the shell or main body to be compressed or reshaped. One of ordinary skill in the art would appreciate that there are numerous ways to configure a bag module to be collapsible, and embodiments of the present invention are contemplated for use with any such configuration.

According to some embodiments of the present invention, a bag module may include an attachment accessory such as a carrying element. In one embodiment, a carrying element could be any feature that could help a user carry, lift, or hold a bag module or the modular bag. In this embodiment carrying elements might include, but are not limited to, handles, handle straps, collapsible pull handles, shoulder straps, back-pack straps, bandoliers, cords, grips, hooks, and similar elements and such carrying elements could be fixed or adjustable. In some embodiments, the carrying element may be incorporated directly into the main body portion of a bag module. As an illustrative example, a carrying handle could be formed in or on the bag module. In some embodiments, the carrying element may be reversibly attachable to a bag module by attaching at an accessory attachment point that is formed in or on a bag module. The accessory attachment point might also be a component that is separately attached to a bag module, for example as a part of a module connector that is a detachable adapter as discussed above. In some embodiments, the accessory attachment point may be configured on the carrying element, for example a shoulder strap that has clip on each end. One of ordinary skill in the art would appreciate that there are many ways of to attach or incorporate a carrying element on a bag module, and embodiments of the present invention are contemplated for use with any such carrying element.

According to some embodiments of the present invention, a bag module may include an attachment accessory such as wheels or similar rolling device to move the modular bag. In one embodiment, the wheels could be any element to facilitate the rolling of the modular bag. In some embodiments, the wheels may be incorporated into the main body portion of one or more of the bag modules. In some embodiments the wheels may attach to a bag module at an accessory attachment point. In some embodiments the wheels may be a part of a frame to which the modular bag attaches. One of ordinary skill in the art would appreciate that there are many possible solutions for adding wheels to a modular bag or bag module, and embodiments of the present invention are contemplated for use with any such solution.

According to some embodiments of the present invention, a bag module may include an attachment accessory such as a hanger element. In one embodiment, the hanger element may be a hook or hanger that attaches to a bag module or garment rolling device. In some embodiments, the hanger element may attach to an accessory attachment point on a bag module, thereby allowing the bag module or modular bag to be suspended, such as on hanger bar in closet. In some embodiments, the hanger element may attach to a garment rolling sheet, thereby permitting the hanger element to function as a garment rolling device that can be suspended from a hanger bar in a closest or the hook of a coat rack. In some embodiments, the hanger element may be configured with a bottle or can opener feature. One of ordinary skill in the art would appreciate that there are many suitable configurations for a hanger element, and embodiments of the present invention are contemplated to take advantage of any such configuration According to some embodiments of the present invention, an attachment accessory, such as a carrying element, will be connected to a bag module at an accessory attachment point. In one embodiment, the accessory attachment point is a connector on the bag module to which one of the attachment accessories can connect. In some embodiments, the accessory attachment point may create a permanent connection with the attachment accessory, while in other embodiments the accessory attachment point facilitates a reversible connection with the attachment accessory. In some embodiments, the accessory attachment point may be formed as part of the bag module itself, while in other embodiments the accessory attachment point will be added via another component that is attached to the bag module. One of ordinary skill in the art would appreciate there are numerous suitable arrangements and designs for an accessory attachment point, and embodiments of the present invention are contemplated for use with such arrangement or design.

According to some embodiments of the present invention, a bag module may include a supplemental storage compartment that is attached the outer side wall of the bag module. In one embodiment, the supplemental storage compartment provides additional storage capacity beyond what is included in the interior of the bag module. In some embodiments, the supplemental storage compartment may be reversibly connectable to the bag module, while in other embodiments of supplemental storage compartment is permanently fixed to the bag module. In some embodiments, a bag module may include both permanent and removable supplemental storage compartments. In this embodiment, the supplemental storage compartment may connect away from the ends of the bag module. In some embodiments, the supplemental storage compartment may connect at the ends of the bag module. One of ordinary skill in the art would appreciate there are many possible configurations for a supplemental storage compartment, and embodiments of present invention are configured for use with any such supplemental storage compartment.

According to some embodiments of the present invention, one or more of the bag modules may be a power module. In one embodiment, possible power modules could include, but are not limited to batteries, photovoltaic chargers, piezoelectric or kinetic chargers, or any other portable energy device or similar power source that could be used to power electrical components of the modular bag or to charge a user's electronic devices. As an illustrative example, the power module could be used to power lights, speakers, digital screens or other electrical components that are incorporated into the modular bag. Similarly, the power module could be used to charge or provide power to external devices such as mobile computing devices, portable hair dryers, electric razor, or other electrical devices. One of ordinary skill in the art would appreciate that a power module would have numerous possible uses and benefits, and embodiments of the present invention are contemplated to take advantage of any such possible use or benefit.

According to some embodiments of the present invention, one or more of the bag modules may be an electronic or digital module. In one embodiment, the electronic module may be a speaker for connecting to external or internal audio devices, a media player, a GPS geolocation device, a digital screen, or an electronic ink display. As an illustrative example, the electronic module could be used to provide a mobile multi-media platform for presentations via various connected display screens and speakers. One of ordinary skill in the art would appreciate that a power module would have numerous possible uses and benefits, and embodiments of the present invention are contemplated to take advantage of any such possible use or benefit.

According to some embodiments of the present invention, the modular and bag modules may incorporate various supplemental features to that give the modular bag additional utility. For example, in some embodiments a bag module may be configured with a series of dividers to provide an organizational system within the bag module. In some embodiments, the bag modules may include endcaps that are adapted to connect at open end points on the bag module, thereby closing off an otherwise open end of the bag module. In some embodiments, each of the bag modules of the modular bag may be connected to each other by cords to prevent one bag module from becoming lost from the other bag modules when the modular bag is disassembled. In some embodiments, the modular bag may include a module securing element, such as a strap or band of material, that is use to stack bag modules side-by-side or atop each other or strap bag modules to other pieces of luggage. One of ordinary skill in the art would appreciate there are many optional components that might be used with the modular bag, and embodiments of the present invention are contemplated for use with any such option components.

According to some embodiments of the present invention, a bag module may include a garment rolling device or garment rolling guide. In one embodiment, a garment rolling device may be cylindrical guide rail or bar, such as a garment rolling bar, around which a garment could be wrapped. In another embodiment, the garment rolling device may be a sheet or layer of material, such as a garment rolling sheet, on which a garment is arranged and then rolled-up in. In some embodiments, the garment rolling sheet may be rectangular and in other it may be shaped like the garment to be rolled-up in the layer of material. As an illustrative example, the garment rolling sheet could be shaped like a jacket or shirt, with extension to support the arms of the jacket or shirt. In some embodiments, the garment rolling sheet may have a cut-out so that pants or other items could be inserted through the cutout before being rolled-up. In some embodiments, the garment rolling sheet may also be configured with folding lines to help facilitate folding of items that are too large for the garment rolling sheet. In another embodiment, the garment rolling device is a garment rolling sheet that is attached to a garment rolling bar, whereby the garment rolling bar could be used to help roll a garment up within the garment rolling sheet. In some embodiments, the garment rolling bar could be at the end of the garment rolling sheet from which the user would start to roll-up the garment to facilitate an even roll. In some embodiments, there may be two garment rolling bars so that the garment could be pinched between the two garment rolling bars to help keep the garment in place while it is rolled-up. In some embodiments, the garment rolling bar could be configured with a hanger element, so that the garment rolling device could be used to suspend garments from a clothing rack. In some embodiments, the garment rolling device may be permanently attached to the bag module, while in other embodiments the garment rolling device is reversibly connected to the bag module. In some embodiments, the garment rolling device may also include a hook-and-loop strip or a tie string that is used to secure the garment rolling device in a rolled-up configuration. One of ordinary skill in the art would appreciate that there are many suitable designs for a garment rolling device, and embodiments of the present invention are contemplated for use with any such design. Additionally, it would be appreciated by one of ordinary skill in the art that the garment rolling device could be used to carry other items such as drawings, rolled documents, and other similar items without departing from spirit and scope of the invention According to some embodiments of the present invention, the garment rolling sheet is flexible to permit the rolling of garments or other items place on the garment rolling sheet. In one embodiment, the garment rolling sheet is continuously bendable in at least the primary rolling direction. In some embodiments, the garment rolling sheet may also comprise a plurality of bending lines arranged perpendicularly to the primary rolling direction, which facilitates a segmented construction of the garment rolling sheet. In some embodiments, the garment rolling sheet can be automatically rolled-up or stretched, in a fashion that is similar to projection screens or window shades. In some embodiments, the garment rolling sheet may also comprise a covering sheet, thereby permitting a garment or other item to be placed between the covering sheet and the garment rolling sheet so that the garment or other item is protected on both sides.

According to some embodiments of the present invention, a garment rolling device is configured to be placed inside of the shell of a bag module. In one embodiment, the garment rolling device may comprise a garment rolling sheet that is a substantially rectangular, flat sheet of thin, light, and flexible material upon which garments or other items could be placed to be rolled-up into a compact tubular form. In this embodiment, the garment rolling device comprises a rolling guide that may act as a clipping device or garment fastening element that is formed by two or more rigid, semi-rigid or bendable rods that are connected in a manner so to permit the rods to be separable, thereby allowing a garment to be firmly secured between the rods when the rods are realigned or reconnected. This relationship may be referred to as the clipping effect. In this embodiment, the rods also function to help initiate the rolling process, as the clipping effect created between the rods keeps the garment from moving during the rolling process. Additionally, the rods provide a larger initial rolling radius that helps reduce the risk for wrinkles. Finally, the rods also push the garment while rolling, thereby creating slight ironing effect. In some embodiments, the garment rolling device may include lateral tabs at the ends of the clipping device. In this embodiment, the tabs are used to provide end-walls that close-off the otherwise open end points of a bag module. In some embodiments, these lateral tabs may have pulls cords or handles on the outer portion of the lateral tabs to allow the garment rolling device to be pulled out of and pushed into the shell of the bag module. In one embodiment, the rods that form the clipping devise are made of fabric, dense foam, cardboard, plastic, light metal, composites, aerogels or any combination of them.

According to some embodiments of the present invention, a garment rolling device is configured to be placed inside of the shell of a bag module. In one embodiment, the garment rolling device may comprise a garment rolling sheet that is a substantially rectangular, flat sheet of thin, light, and flexible material upon which garments or other items could be placed to be rolled-up into a compact tubular form. In this embodiment, the garment rolling device also comprises one rigid or semi-rigid rod at one end of the sheet, which has a length that is greater than or equal to the width of the sheet. The one rigid or semi-rigid rod provides a larger rolling radius that helps reduce the occurrence of wrinkles. In some embodiments, the garment rolling device may include lateral tabs at the ends of each side of the sheet, which are connected to the one rod at that end of the sheet. In this embodiment, the tabs are used to provide end-walls that close-off the otherwise open end points of a bag module. In some embodiments, the garment rolling device may also include a hook-and-loop strip or a tie string that is used to secure the garment rolling device in a rolled-up configuration. In some embodiments, these lateral tabs may have pulls cords or handles on the outer portion of the lateral tabs to allow the garment rolling device to be pulled out of and pushed into the shell of the bag module.

According to some embodiments of the present invention, a garment rolling device may include a clipping device element that secures the garment during the rolling process and that can be placed inside of the shell of a bag module. In one embodiment, the clipping device element could be one or more clips or claps. In another embodiment, the clipping device element may comprise two or more bars that are separable so that a garment can be secured between the two bars when the two bars are place stacked together. In any embodiment, the clipping device element enables the garments to be rolled more easily, thereby reducing the time required for rolling the garment. In particular, the clipping device element prevents the garment from moving around during rolling, which helps to eliminate the wrinkles that can be caused by the undesired shifting of the garment within the garment rolling sheet. In one embodiment, the clipping device will be connected to a rolling sheet of the garment rolling device. In another embodiment, the clipping device will be separate and independent from a rolling sheet of the garment rolling device. In one embodiment, the bars that form the clipping devise are made of fabric, dense foam, cardboard, plastic, light metal, composites, aerogels or any combination of them.

According to some embodiments of the present invention, a garment rolling device may comprise a hanger element that can be place inside of the shell of a bag module. In one embodiment, the hanger element comprises a first hanger bar, a second hanger bar, and a hook. In this embodiment, the first hanger bar may be a rigid or semi-rigid bar that has the length of a traditional hanger. In another embodiment, the first hanger bar may be bendable. The first hanger bar may include clips that are fully or partially embedded in the hanger bar. These clips can be used to clip pants to the first hanger bar or be used to clip onto a separate garment rolling sheet, thereby allowing the first hanger bar to function as a garment rolling guide bar. In this embodiment, the second hanger bar may be a rigid, semi-rigid, or flexible bar that is shorter than and connected to the first hanger bar by a connector sheet that may be rigid, semi-rigid or flexible. The second hanger bar may be configured to align near the collar of a blazer, thereby providing resistance and strength to the blazer before rolling and further minimizing wrinkles to the garment. In this embodiment, the hook attaches to one of the hanger bars to permit the hanger bar to be suspended in a closet or on a hook of a coat rack. The hook is preferably removable, so as to allow an easier rolling process and to prevent any possible damage to the garment by the hook. In one embodiment, the bars that form the hanger device are made of fabric, dense foam, cardboard, plastic, light metal, composites, aerogels or any combination of them.

According to some embodiments of the present invention, the garment rolling device or garment rolling guide can reduce wrinkles in suits by separating the rolled suit jacket from the rolled suit pant, which, most importantly, allows for both pieces of the suit to be rolled into a small diameter form factor. In one embodiment, this strategy together with the bag modules discussed above, facilitates connecting a number of bag modules, each of which may contain rolled garments, in end-to-end configuration, thereby creating a long, thin tube-like solution that provides an easy and comfortable way to carry the combined suit bag, similarly to the way large poster tubes are carried.

According to some embodiments of the present invention, a bag module may be configured as a garment bag. In one embodiment, the garment bag is comprised of a non-flexible tube-like shell that has a diameter in the range of 9 to 20 cm. The shell of the garment bag forms a storage cavity in which a rolled or furled garment or other rolled item can be stored. In particular, the bag module configured as a garment bag will be adapted to work with any of the garment rolling device discussed above. In this embodiment, the shell of the garment bag may have an access point formed at one or both ends of the garment bag module. In another embodiment, the garment bag may have an access point formed in the longitudinal axis of the shell wall. Additionally, it would be appreciate that any bag module that is configured as a garment bag could incorporate any of the features, functions, and designs previously discussed in relation to the bag module. For example a garment bag could be built from the same materials or be of any of the shapes discussed above in reference to a bag module to provide a tube-like shape. Furthermore, the garment bag could include any of the accessories that could be added to standard bag module, including but not limited to (i) fixed and adjustable holding elements such as holders, cords, grips, bandoliers, shoulder straps, backpack straps, hooks or retractable handles and (ii) supplemental storage compartments that are permanently fixed or removable.

Exemplary Embodiments

According to some embodiments of the present invention, a primary function of the modular bag will be for use as a garment bag that will be capable of carrying, through the use of variously configured modules, hanging garments, such as blazers and pants, as well as other items a typical traveler would need including, but not limited to, clothing, footwear, undergarments, toiletries, and travel documents. In one embodiment, the modular bag is a versatile baggage solution capable of being arranged in a myriad of configurations, based on the needs of a user. As an illustrative example, the modular bag may be used for activities that include but, are not limited to, a weekend travel suitcase; a camping bag configured to carry an inflatable mattress and other outdoor items; a beach bag to carry towels, drinks, food, and other beach items; a gym bag with separate compartments for clean and wet or dirty items; a photographers bag to carry and protect cameras, lenses, mounts, and other accessories; portable multimedia system with speakers, projectors, and lights; musical instrument and accessory bag, particularly for flutes, clarinets and similar sized instruments; a mountaineering bag to carry clothes and drinks while trekking; or as portfolio bag to carry rolled documents or artwork in different compartments. One of ordinary skill in the art would appreciate that the modular bag could be arranged in a myriad of configurations, and embodiments of the present invention are contemplated for use in any such configuration.

According to some embodiments of the present invention, each module of the modular bag may be configured to carry different types of items. In one embodiment, module types may include, but are not limited to a blazer-holder module, a pants-holder module, a belt and accessories module, an undergarments module, a shoe module, an electronics module, a power source module, and a food and beverage module. In this embodiment, differently configured modules are then able to be connected in a myriad of different arrangements, as the module connectors on each of the modules allow for modules to be connected to each other. One of ordinary skill in the art would appreciate that a bag module could be configured for nearly any type of item that could physically fit into a bag module, and embodiments of the present invention are contemplated for use with such bag module configuration.

According to some embodiments of the present invention, the multi-purpose modular travel bag is highly adaptable and can be arranged in a variety of sizes. In one embodiment, the modular travel bag can be easily reconfigured to comply with the carry-on size requirements of an airline. As an illustrative example, a modular bag allows a traveler to recombine the modules as needed while at the airport to meet the maximum carry-on dimensions of a particular airplane or airline. Moreover, in many cases, airlines allow thin and long elongated objects, like drawing tubes, to be carried as carry-on items even if the length of the item is longer than the maximum length of a traditional suitcase. As such, the modules of the modular bag could be arranged so that the bag is a long, thin tube that is acceptable as a carry-on item.

Turning now to FIG. 1, an exemplary embodiment of a modular bag in accordance with an embodiment of the present invention. In this exemplary embodiment, the modular bag 1000 comprises one or more bag modules 1010, 1020, and 1030 that are connected via module connectors 1013 and 1014. In this embodiment, a bag module 1010 may have an access point 1012 formed in a side wall of the bag module 1010 and that access point 1012 may be secured by an access point securing device 1011. Additionally, the modular bag 1000 may be configured with a carrying element 1040.

Figure 2:
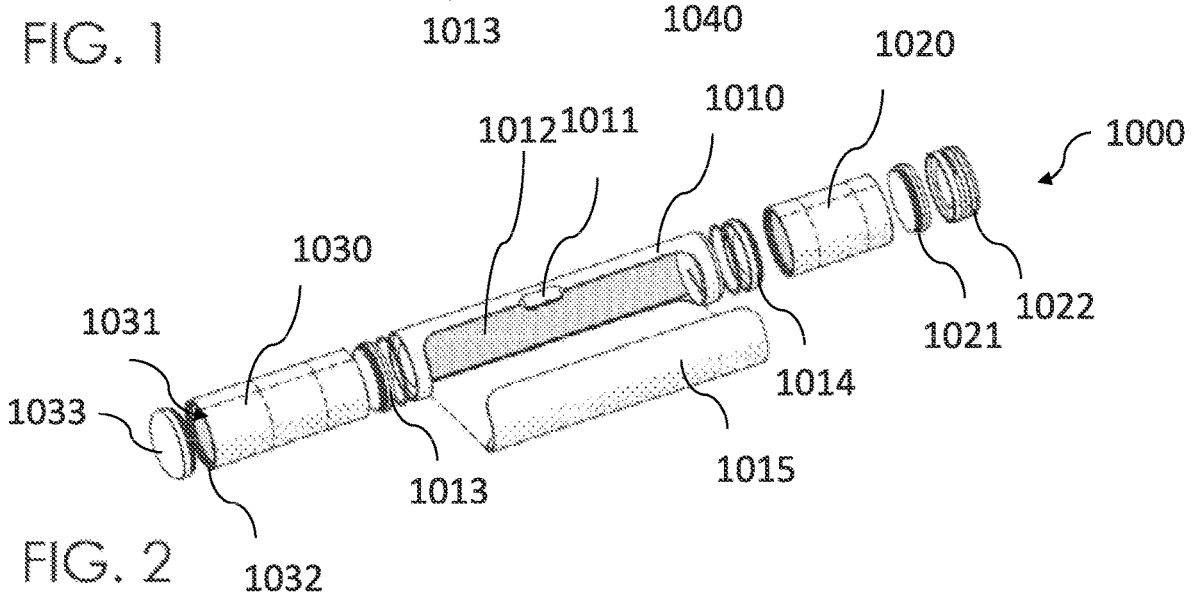
FIG. 2 is an exploded view of a modular bag, in accordance with an embodiment of the present invention.

Turning now to FIG. 2, an exemplary embodiment of a modular bag in accordance with an embodiment of the present invention. In this exemplary embodiment, the modular bag 1000 comprises one or more bag modules 1010, 1020, and 1030 that are connected via module connectors 1013 and 1014. In this embodiment, a bag module 1010 may have an access point 1012 formed in a side wall of the bag module 1010 and that access point 1012 may be covered by an access door 1015 that is secured by an access point securing device 1011. Additionally, certain of the bag modules 1030 may have an access point 1031 formed at an end point 1032 of the bag module 1030 and that end point could be covered by an endcap 1033.

Figure 3A:
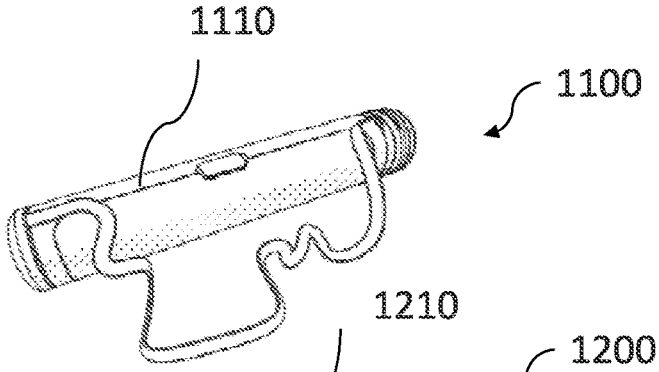
FIGS. 3A-C are perspective views of a modular bag configured with a varying arrangement of bag modules, in accordance with an embodiment of the present invention.
Figure 3B:
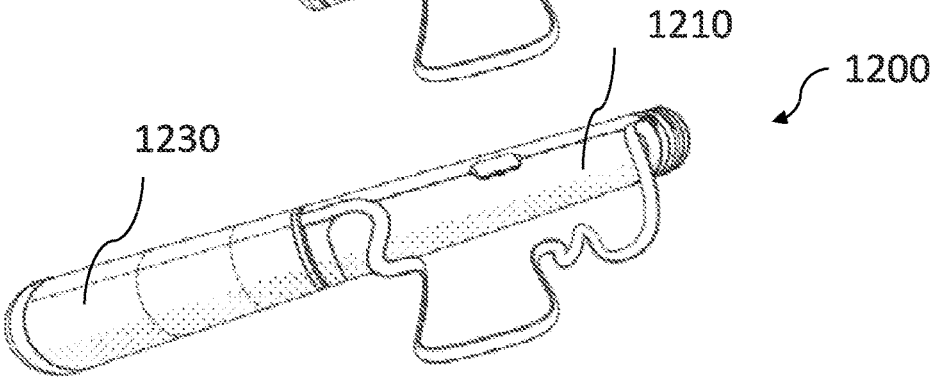
Figure 3C:
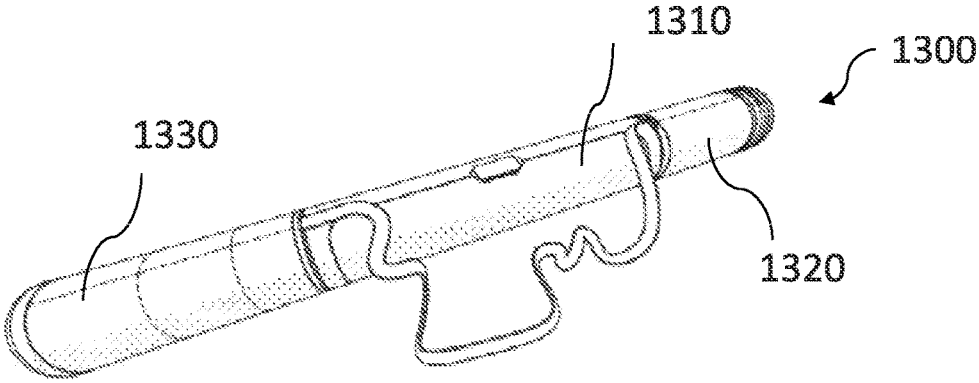

Turning now to FIGS. 3A-C, exemplary embodiments of a modular bag in various configurations in accordance with an embodiment of the present invention. FIG. 3A shows an exemplary embodiment of a modular bag 1100 with one bag module 1110, that could be configured as, but not limited to a jacket holder. FIG. 3B shows an exemplary embodiment of a modular bag 1200 with two bag modules 1210 and 1230, where one bag module may be a jacket holder and the other a pants holder. FIG. 3C shows an exemplary embodiment of a modular bag 1300 with three bag modules 1310, 1320, and 1330, where one bag module may be a jacket holder, the second a pants holder, and the third an accessories holder. One of ordinary skill in the art would appreciate that any module could be configured to carry any item and such modules are not limited to carrying a jacket, pants, or other accessories.

Figure 4:
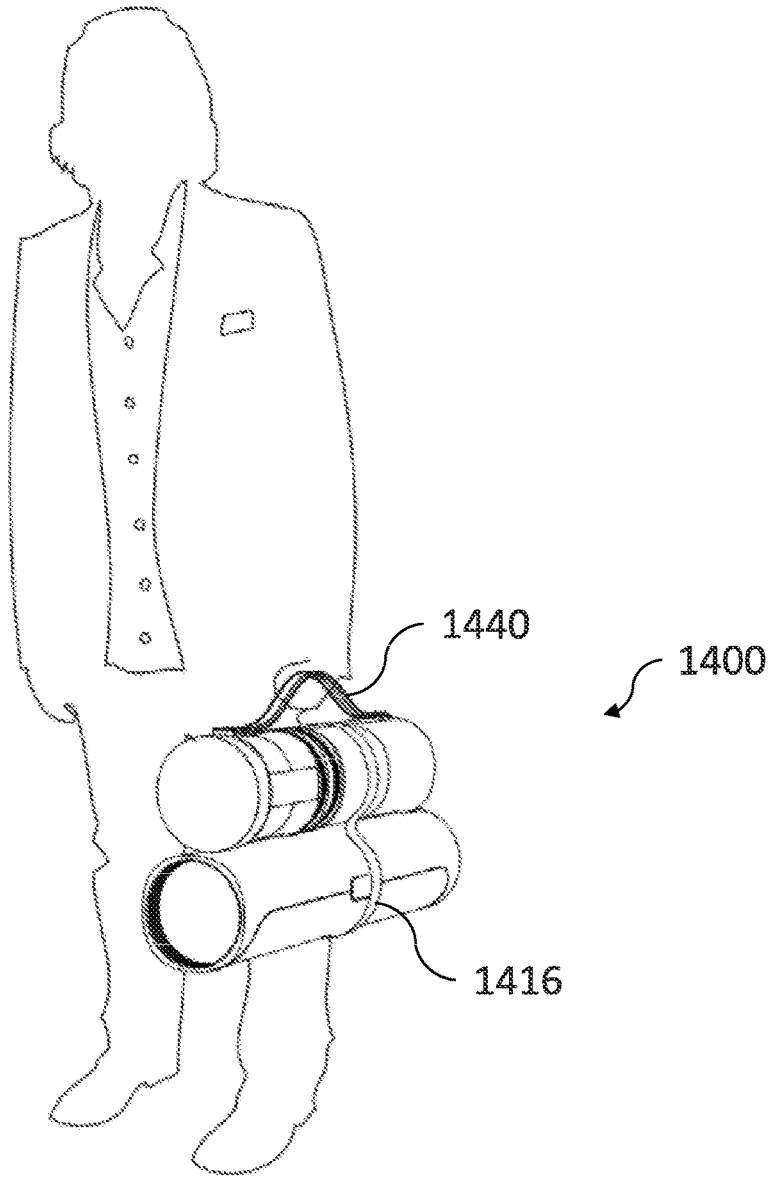
FIG. 4 is an illustration of a person carrying a modular bag with the modules connected in a side-by-side configuration, in accordance with an embodiment of the present invention.

Turning now to FIG. 4, an exemplary embodiment of a modular bag in accordance with an embodiment of the present invention. In this exemplary embodiment, the modular bag 1400 is shown in a stacked configuration with two sections of the modular bag 1400 being secured by a module securing element 1416. In this embodiment, the module securing element 1416 allows two or more sections of one or more bag modules to be stacked side-by-side or atop each other so that the modular bag 1400 can be used as carry-on bag with the carrying element 1440. Furthermore, the use of a module securing element 1416 allows for various modules to be connected together without the use of a direct, end-to-end connectors.

Figure 5A:
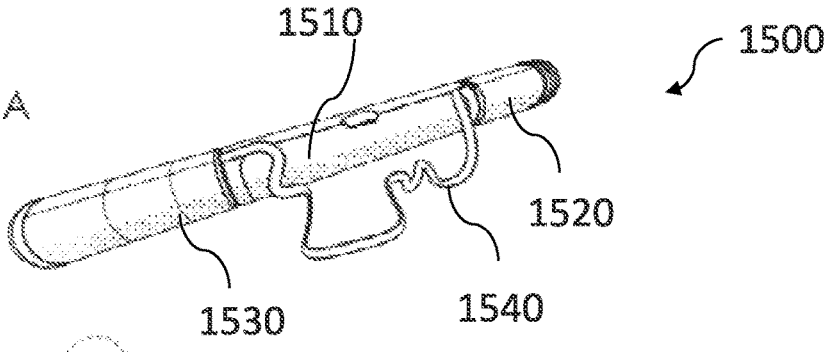
FIGS. 5A-C illustrate modular bags with the modules connected in various end-to-end configuration, in accordance with an embodiment of the present invention.
Figure 5B:
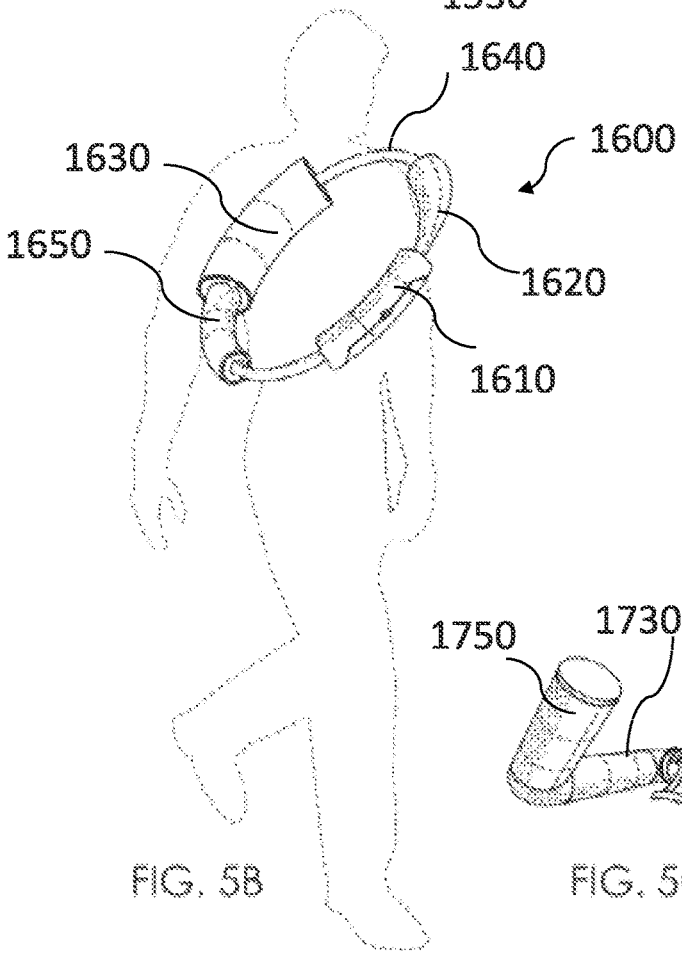
Figure 5C:
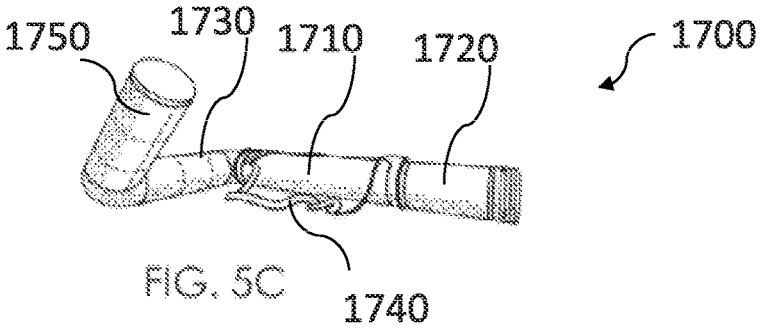

Turning now to FIG. 5A-C, an exemplary embodiment of a modular bag in accordance with an embodiment of the present invention. In this exemplary embodiment, the modular bag 1500 is configured with a center bag module 1510 that has a carrying element 1540. In some embodiments, the carrying element 1540 is a shoulder strap that allows the modular bag to be carried in a hands-free fashion. As shown in FIGS. 5B and 5C it can be seen that the modules of the bag do not have to be arranged in a straight linear format as in FIG. 5A. FIG. 5B shows the modular bag 1600 comprising modules 1610, 1620, 1630, 1640, and 1650. FIG. 5C shows the modular bag 1700 comprising modules 1710, 1720, 1730, 1740, and 1750. For example, the modules could be arrange in a circular arrangement as in FIG. 5B and worn around the body. Additionally, the modules can be arranged at varying angles, as in FIG. 5C depending on the needs of the user. In some embodiments, the modules of the modular bag may be directly connected to each other as in FIGS. 5A and 5C, while in other embodiments, the modules may be connected by elements that merely serve as a connector between two adjacent modules, as shown by component 120 in FIG. 5B. Such connectors may be a rigid, semi-rigid, or flexible piece.

Figure 6:
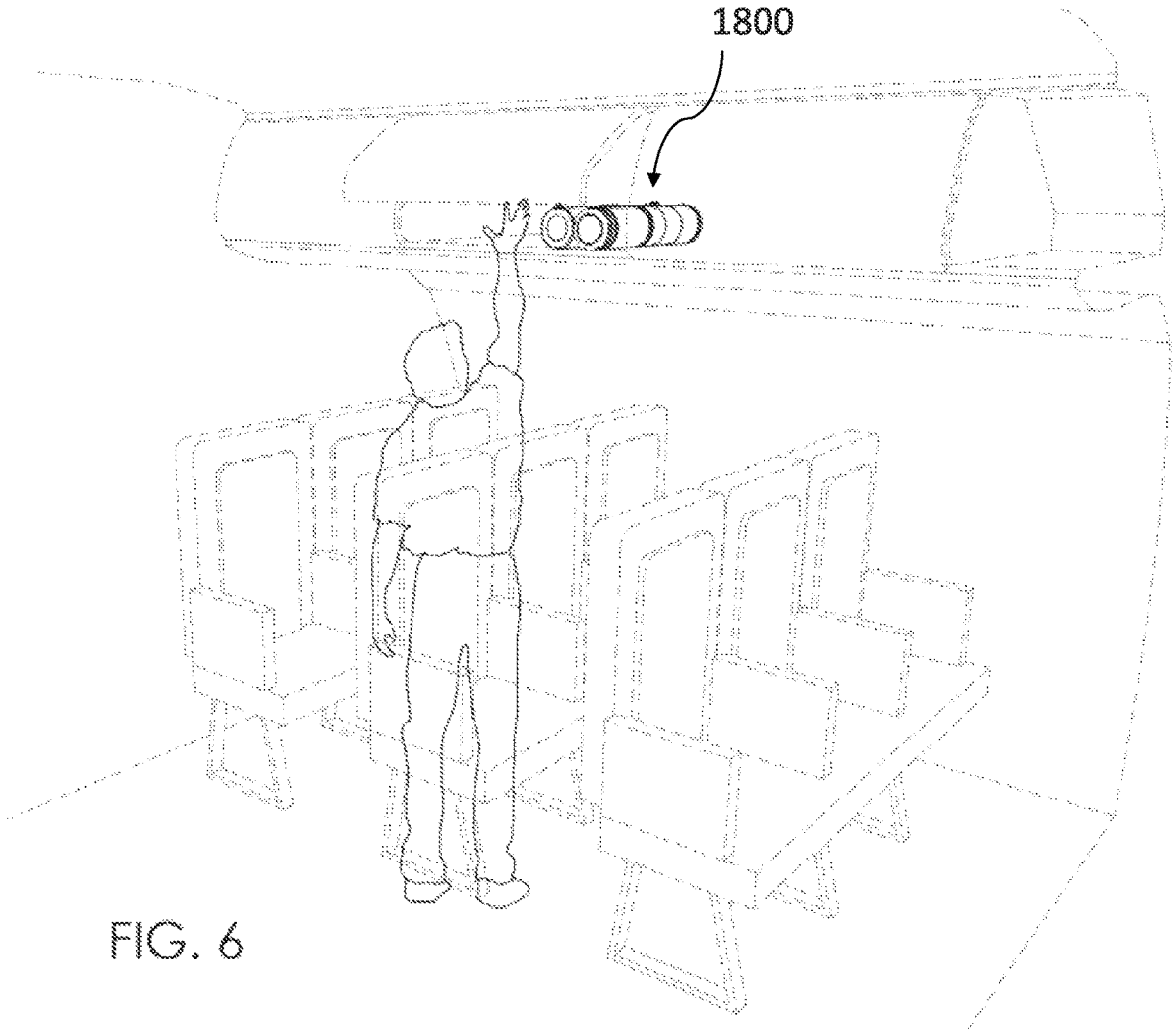
FIG. 6 is an illustration of a modular bag being stowed in an overhead bin of an airplane, in accordance with an embodiment of the present invention.
Figure 7:
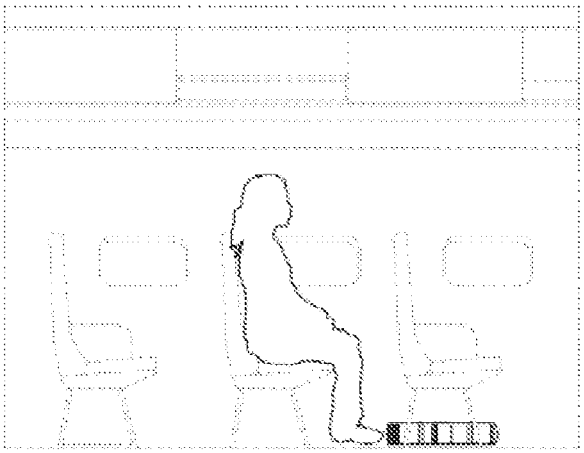
FIG. 7 is an illustration of a modular bag stowed underneath a seat of an airplane, in accordance with an embodiment of the present invention.
Figure 8:
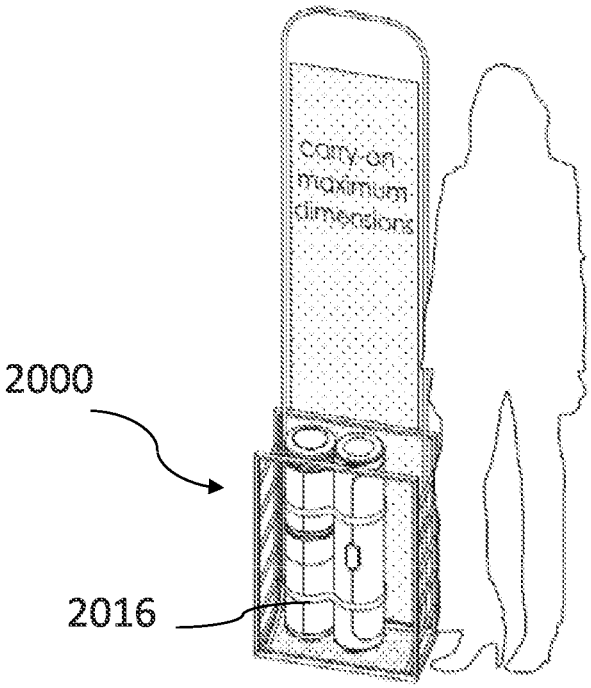
FIG. 8 is an illustration of a modular bag being checked for compliance with carry-on baggage dimension limits, in accordance with an embodiment of the present invention.

Turning now to FIGS. 6-8, an exemplary embodiment of a modular bag being used in various aspects of air travel in accordance with an embodiment of the present invention. FIG. 6 shows an exemplary embodiment of a modular bag 1800 being stowed in an overhead storage bin of an airplane. FIG. 7 shows an exemplary embodiment of a modular bag 1900 being stowed beneath the seat of an airplane. FIG. 8 shows an exemplary embodiment of a modular bag 2000 being tested for compliance with carry-on baggage dimension limits.

Figures 10A, 10B, 10C, 10D, 10E, 10F, 10G, 10H:
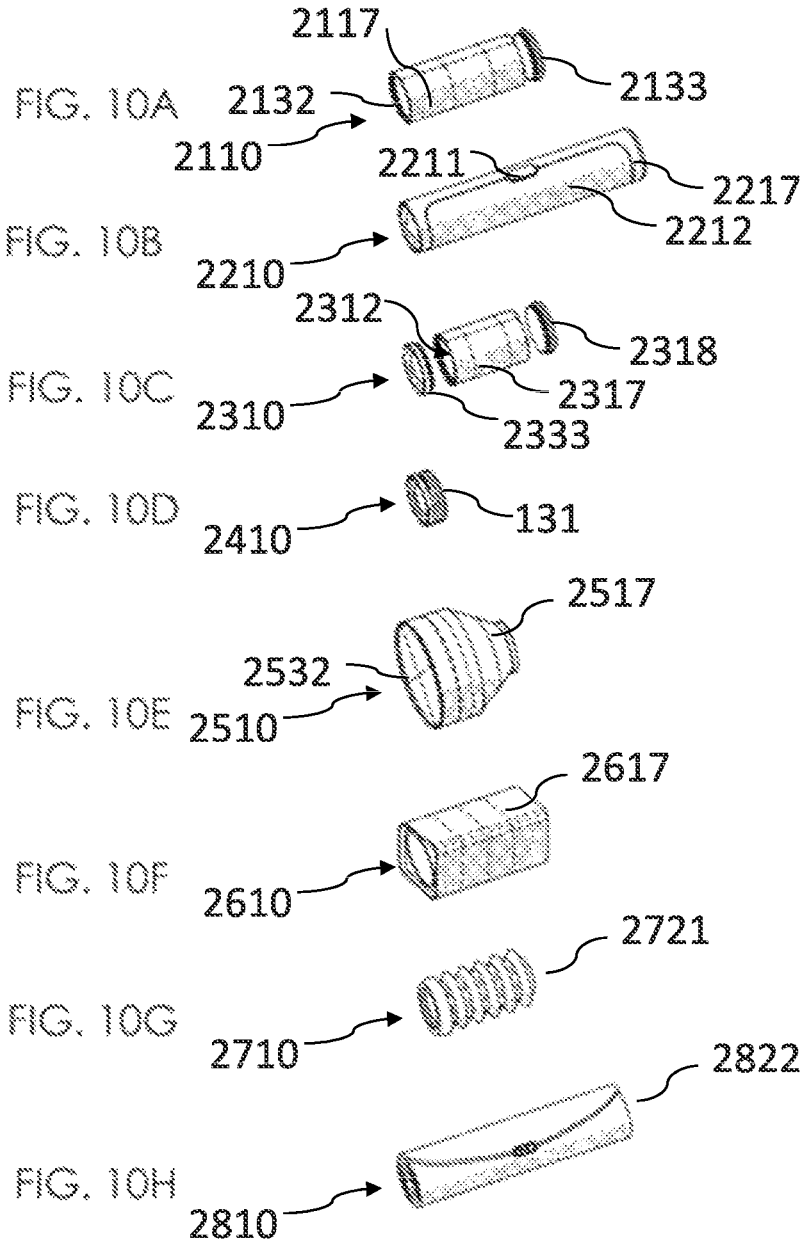
FIGS. 10A-H is a perspective view of the various components of a modular bag, in accordance with an embodiment of the present invention.

Turning now to FIGS. 9 and 10A-H, exemplary embodiments of the various shapes and components of a modular bag. As shown in FIG. 9, the shell of modular bag could be configured in a variety of shapes, including but not limited to circular, hexagonal, pentagonal, oval, triangular, and square. In some embodiments is the shell is a rolled sheet of material that creates a tube-like shell. In some embodiments a bag module is formed from one or more sheets of material that are rolled to provide a tubular bag module. In some embodiments, the shell could be inflatable. As shown in FIG. 10A-H, the bag modules and other components that comprise a modular bag could come in many shapes in sizes. FIG. 10A shows an exemplary embodiment of a bag module 2110 with a main body portion 2117 and one end point 2132 that is open and another that is secured by an endcap 2133. FIG. 10B shows an exemplary embodiment of a bag module 2210 with a main body portion 2217 that has an access point 2212 that is secured by a access point securing device 2211. FIG. 10C shows an exemplary embodiment of a bag module 2310 with a main body portion 2317 where the end point is also an access point 2312 and each end point is secured by an endcap 2333. FIG. 10D shows an exemplary embodiment of a solid module 2410 that can act as a power source 131 for an electronic device, such as a battery, audiovisual device (e.g. speakers or a display element) or geolocation element (e.g. GPS system). FIG. 10E shows an exemplary embodiment of a bag module 2510 that has a conical main body portion 2517 that is closed at one end and has an open end 2532 at the other. FIG. 10F shows an exemplary embodiment of a bag module 2610 that has a square shaped section as main body portion 2617. FIG. 10G shows an exemplary embodiment of a module 2710 that acts as a hinge or joint 2721 that allows consecutively connected modules to be bent, twisted, split or otherwise aligned onto a different axis relative to an adjoining bag module. In this embodiment, the hinge or joint may be an accordion joint, a ball-and-socket joint inner structure, or a splitter connection (e.g. "Y-shaped" or "T-shaped connector junction) that allows a user to add bag modules in a manner that creates geometrical complexity in the combined modular bag. FIG. 10H shows an exemplary embodiment of a bag module 2810 formed from a rolled module wall sheet 2822.

Figure 11A:
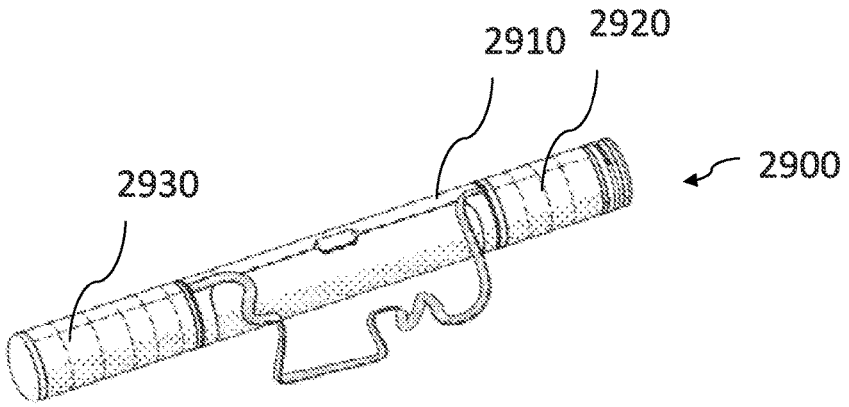
FIG. 11A-B are perspective views of modular bags with differing arrangements of bag modules, in accordance with an embodiment of the present invention.
Figure 11B:
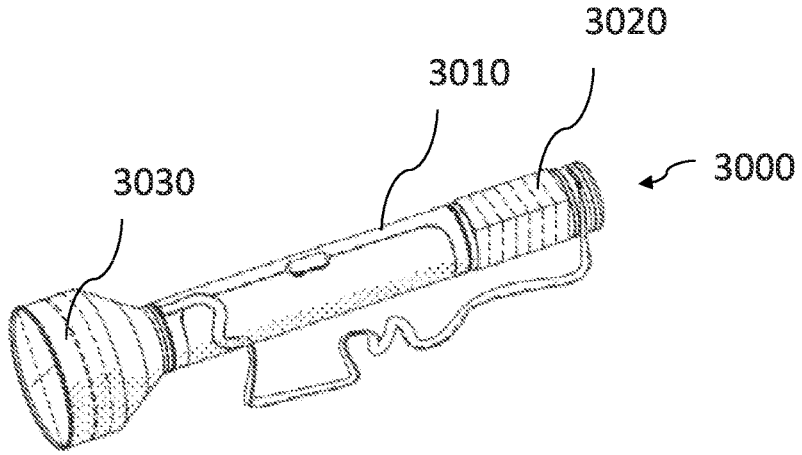

Turning now to FIGS. 11A and B, exemplary embodiments of a modular bag configured with different bag modules, in accordance with embodiments of the present invention. As shown in FIG. 11A, the modular bag 2900 could be assembled with bag modules 2910, 2920, and 2930 that are of similar shape to form a modular bag 2900 with a single continuous form factor. As shown in FIG. 11B, the modular bag 3000 could be assembled with bag modules 3010, 3020, and 3030 that are of different shapes to form a modular bag 3000 with a varying form factor.

Figure 12:
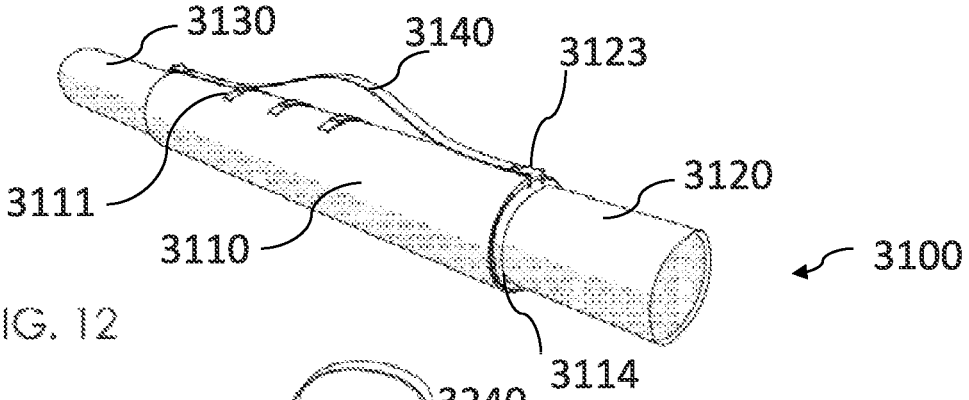
FIG. 12 is a perspective of a modular bag, in accordance with an embodiment of the present invention.

Turning now to FIG. 12, an exemplary embodiment of a modular bag with a carrying element, in accordance with an embodiment of the present invention. In one embodiment, the modular bag 3100 may include a carrying element 3140 that attaches to the modular bag 3100 at an attachment point 3123.

Figure 13:
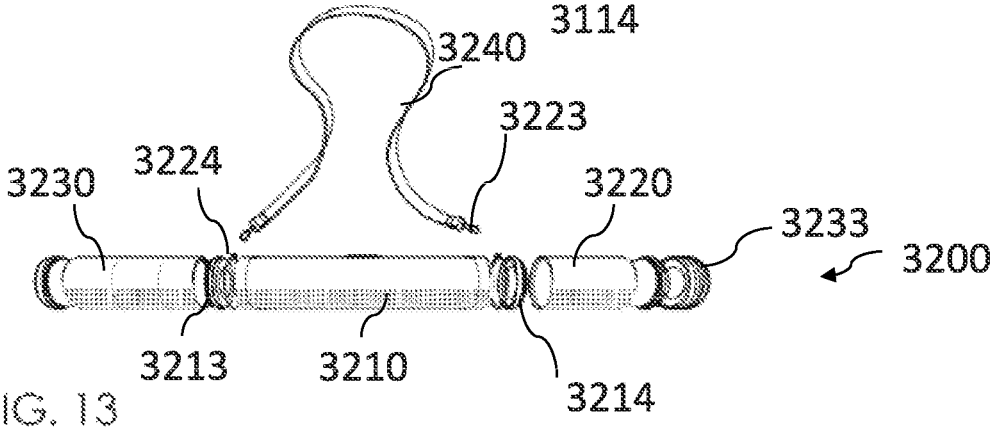
FIG. 13 is an exploded view of a modular bag with a carrying element, in accordance with an embodiment of the present invention.

Turning now to FIG. 13, an exemplary embodiment of a modular bag with a carrying element, in accordance with an embodiment of the present invention. In one embodiment, the modular bag 3200 may include a carrying element 3240 that attaches to the modular bag 3200 at an accessory attachment point 3223. In some embodiments, there may be an accessory attachment point 3223 on the carrying element 3240 and a corresponding accessory attachment point 3224 as one of the components on the modular bag. In particular, an accessory attachment point 3224 may be attached as a separate component that is secured to the modular bag 3200 by one of the module connectors 3213, where the module connectors 3213 and 3214 can be either a permanently attached or detachable component.

Figure 14:
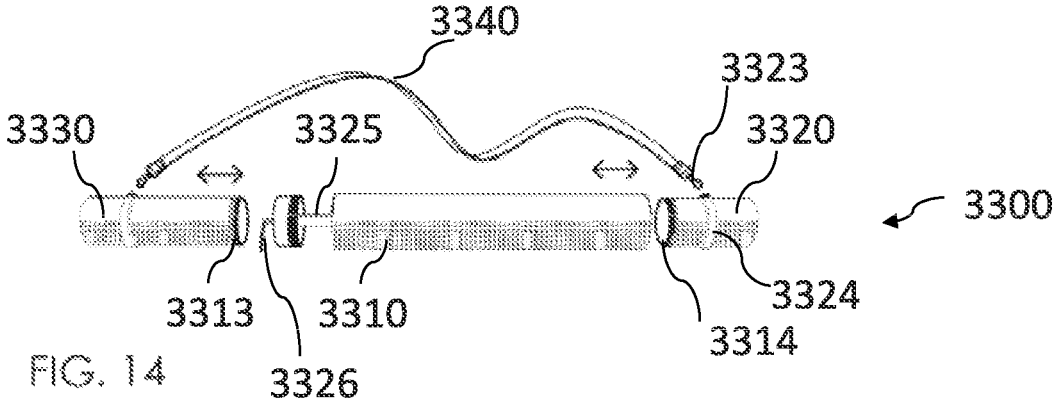
FIG. 14 is an exploded view of an alternate embodiment of a modular bag with a carrying element, in accordance with an embodiment of the present invention.

Turning now to FIG. 14, an exemplary embodiment of a modular bag with a carrying element, in accordance with an embodiment of the present invention. In one embodiment, the modular bag 3300 may include a carrying element 3340 that attaches to the modular bag 3300 at an adjustable attachment point 3313. In some embodiments, there may be an accessory attachment point 3323 on the carrying element 3340 and a corresponding accessory attachment point 3324 as one of the components on the modular bag. Additionally, in some embodiments of the modular bag, the module connectors 3314 may be formed directly on one or more of the bag modules. Finally, a bag module 3310 may be configured to receive a garment rolling device 3325. In one embodiment, the garment rolling device 3325, may include a pull strap or handle 3326 to help a user pull the garment rolling device out of or insert the garment rolling device 3325 into a bag module 3310.

Figure 15:
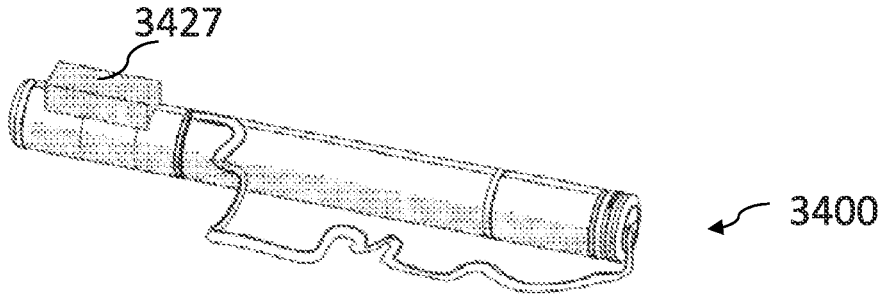
FIG. 15 is a perspective view of a modular bag with a supplemental storage compartment, in accordance with an embodiment of the present invention.

Turning now to FIG. 15, an exemplary embodiment of a modular bag with a supplemental storage compartment, in accordance with an embodiment of the present invention. In one embodiment, the modular bag may include a supplemental storage compartment 3427 that can be attached to the outside of the modular bag 3400.

Figure 16:
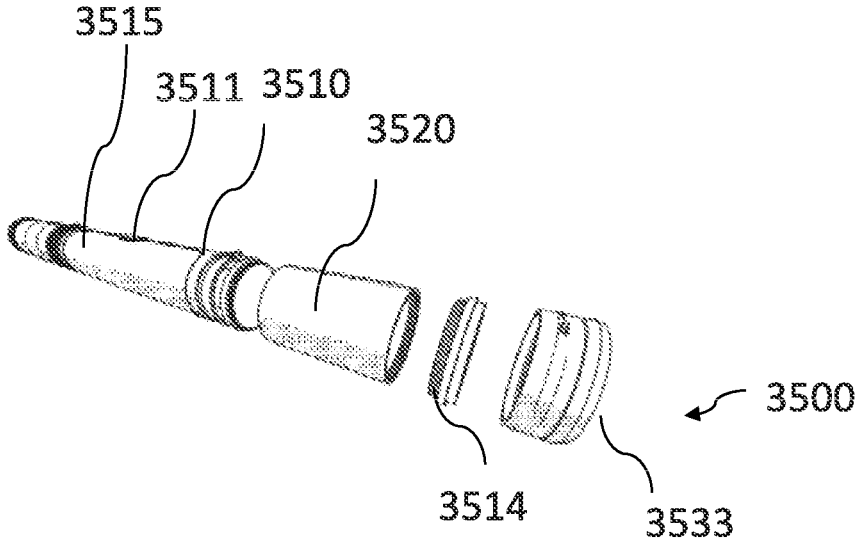
FIG. 16 is an exploded view of alternately configured bag modules and connectors of a modular bag, in accordance with an embodiment of the present invention.

Turning now to FIG. 16, an exemplary embodiment of a modular bag, in accordance with an embodiment of the present invention. In one embodiment, a bag module 3510 may be configured with an access point securing device 3511 that holds an access door 3515 in place over an access point. From this embodiment, it can also be seen that a module connector 3514 can be formed directly on a bag module or as a separate component. In some embodiments, the modular bag 3500 may also include an endcap 3533 that attaches to a bag module 3520 via a module connector 3514. In one embodiment, each module 3510 and 3520 is capable of functioning independently and could be have its ends secured by an endcap 3533, as opposed to by another module.

Turning now to FIGS. 17 and 18, exemplary embodiments of a modular bag being carried by on the back of a user, in accordance with embodiments of the present invention. As shown by FIG. 17, a modular bag 3600 could be carried over the shoulder of a user. As shown by FIG. 18, a modular bag 3700 could be carried across the back of a user.

Figure 19:
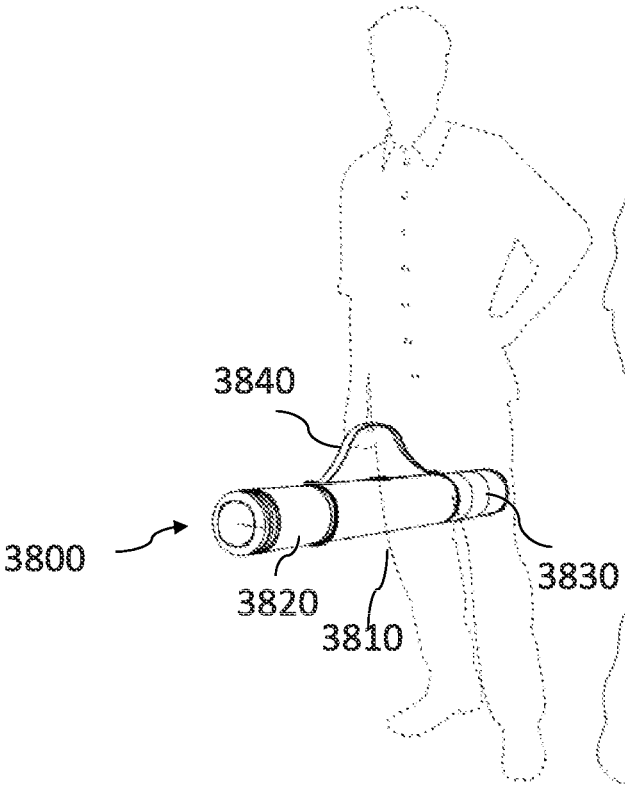
FIG. 19 is an illustration of modular bag being carried with each of the bag modules connected in an end-to-end configuration, in accordance with an embodiment of the present invention.
Figure 20:
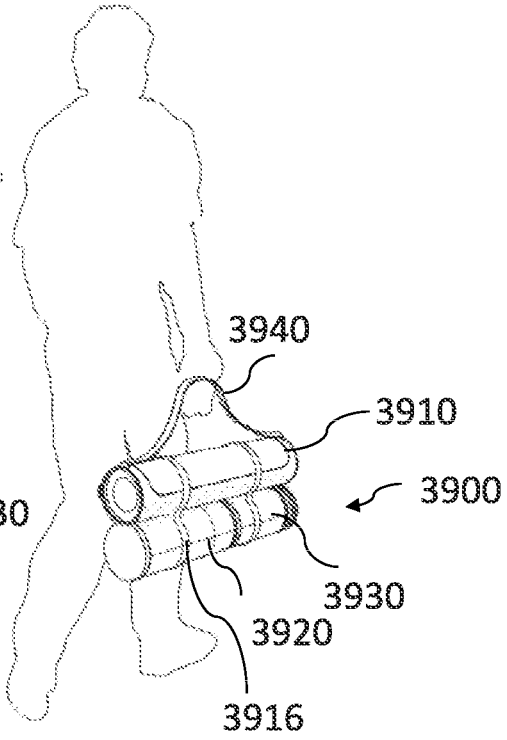
FIG. 20 is an illustration of modular bag being carried with two sets of modules connected in a side-by-side configuration, with one set of modules stacked atop the other, in accordance with an embodiment of the present invention.

Turning now to FIGS. 19 and 20, exemplary embodiments of a modular bag being carried by in the hand of user, in accordance with embodiments of the present invention. As shown by FIG. 19, a modular bag 3800 could be carried with a carrying element 3840 in the hand of a user with each bag module 3810, and 3820, 3830 being connected end-to-end. As shown by FIG. 20, a modular bag 3900 could be carried with a carrying element 3940 in the hand of a user such that two or more sections of one or more bag modules 3910, 3920, and 3930 are stacked side-by-side or atop each other and secured by a module securing connection element 3916.

Figure 21A:
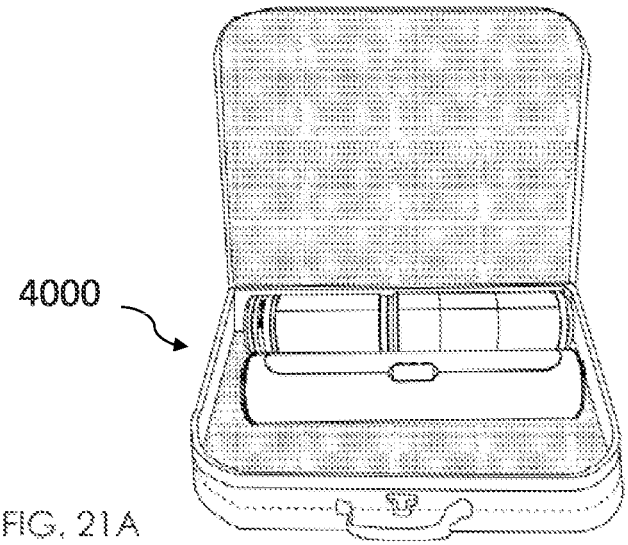
FIGS. 21A-D are illustrations of a modular bag being carried with other traditional forms of baggage, in accordance with an embodiment of the present invention.
Figure 21B:
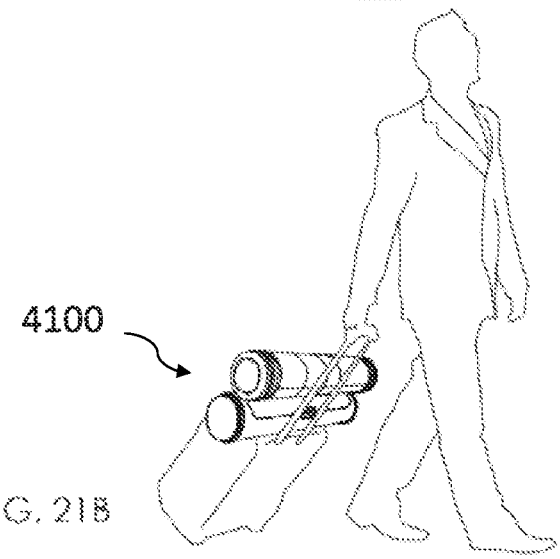
Figures 21C, 21D:
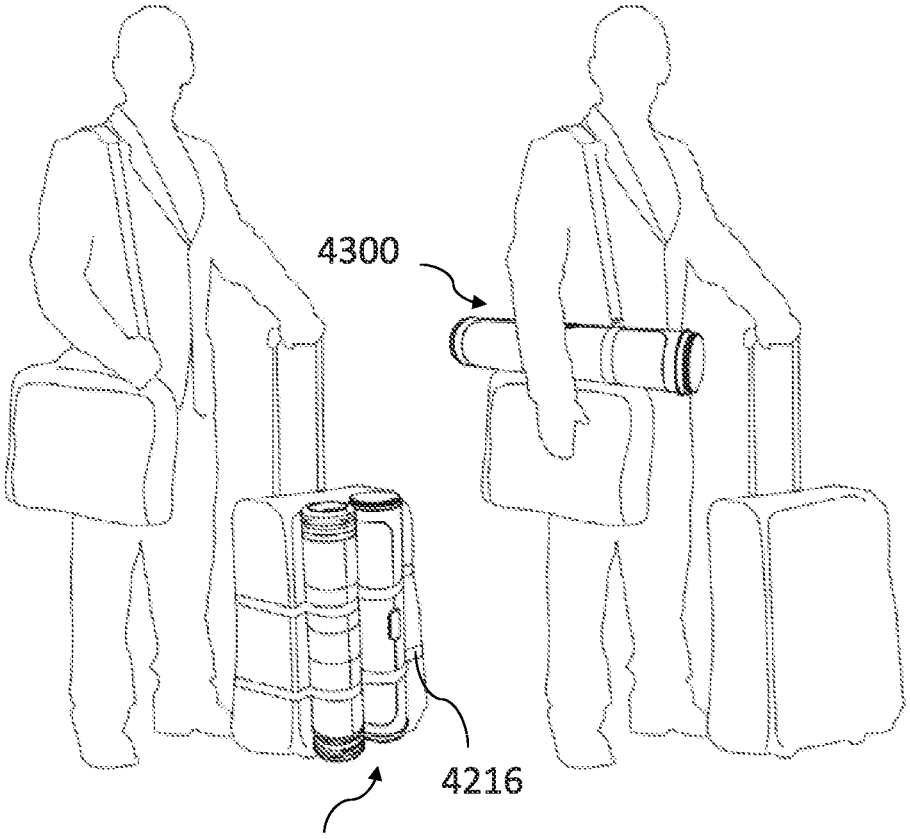

Turning now to FIGS. 21A-D, exemplary embodiments of a how a modular bag could be used with other pieces of luggage, in accordance with an embodiment of the present invention. As shown in FIG. 21A, a modular bag 4000 could be carried inside of another piece of luggage. As shown in FIGS. 21B and C, a modular bag 4100 could be carried on the outside a piece of wheeled luggage, where the modular bag either rests on top of the wheeled luggage is or, as shown in FIG. 21C, the modular bag 4200 is strapped to the front of the wheeled luggage by a module securing element 4216.

As shown in FIG. 21D, the modular bag 4300 could be carried along with a shoulder bag.

Figure 22:
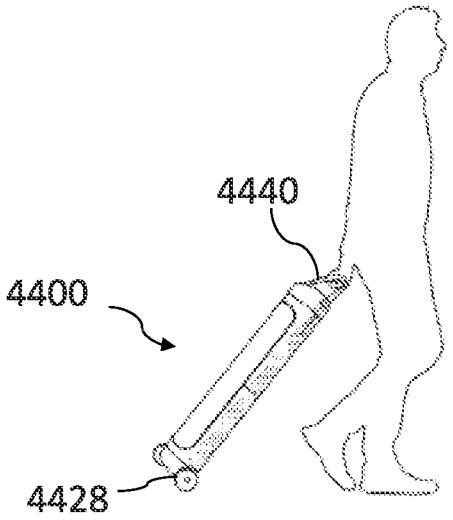
FIG. 22 is an illustration of a modular bag that is configured with wheels, in accordance with an embodiment of the present invention.
Figure 23:
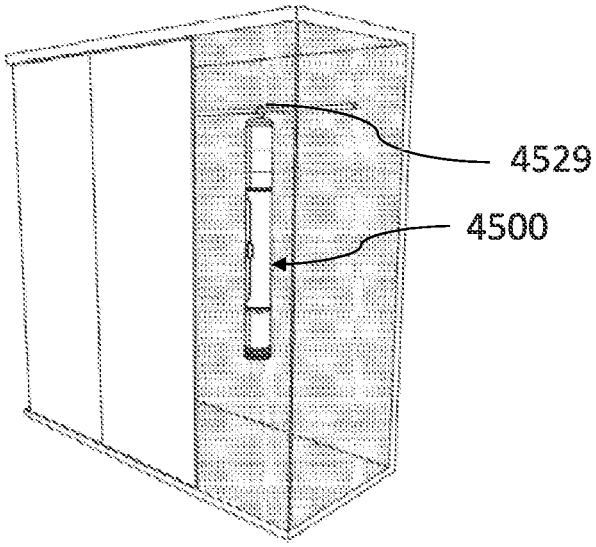
FIG. 23 is an illustration of a modular bag that is configured with a hanger element, in accordance with an embodiment of the present invention.

Turning now to FIGS. 22 and 23, exemplary embodiments of a modular bag with various attachment accessories, in accordance with embodiments of the present invention. As shown in FIG. 22, in some embodiments the modular bag 4400 may include a component that attaches wheels 4428 to the modular bag 4400 that allow the user to pull the modular bag 4400 with a carrying element 4440, such as pull-strap. As shown in FIG. 23, in some embodiments the modular bag 4500 may include a component that attaches a hanger element 4529 to the modular bag 4500 so that the modular bag 4500 can be suspended and stored in a closet.

Figure 24:
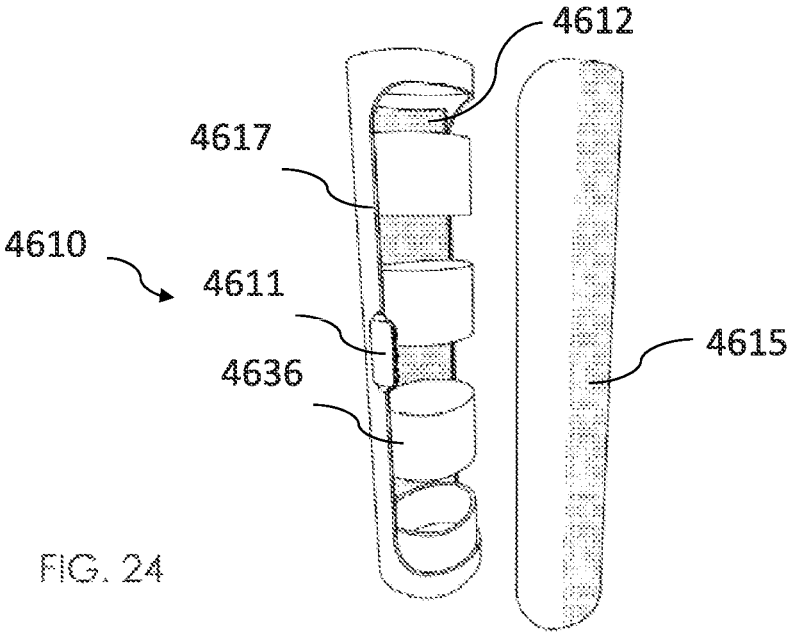
FIG. 24 is an illustration of a bag module that is configured with dividers, in accordance with an embodiment of the present invention.

Turning now to FIG. 24, an exemplary embodiment of a bag module, in accordance with an embodiment of the present invention. In one embodiment, a bag module 4610 may have an access point 4612 formed in the side wall of the main body portion 4617. That access point 4612 may be covered by an access door 4615 that can be secured in place by an access point securing device 4611. In some embodiments the bag module 4610 may include dividers 4636 to organize the interior of the main body portion 4617.

Figure 25A:
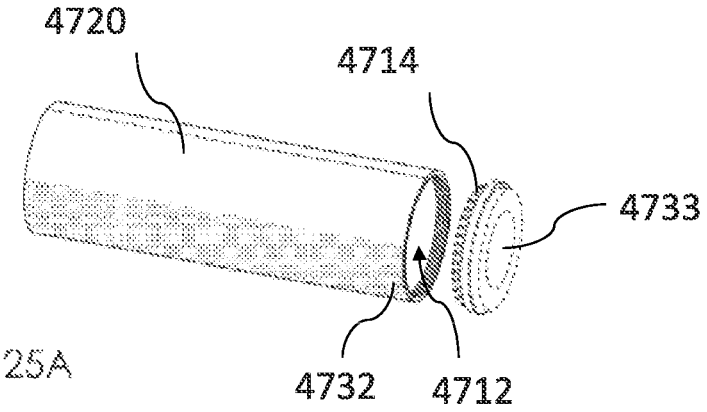
FIGS. 25A-D illustrates various access points on a bag module, in accordance with an embodiment of the present invention.
Figure 25B:
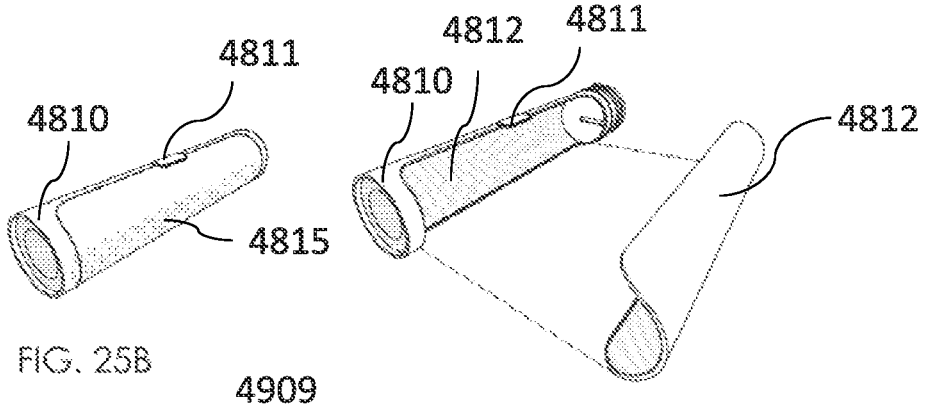
Figure 25C:
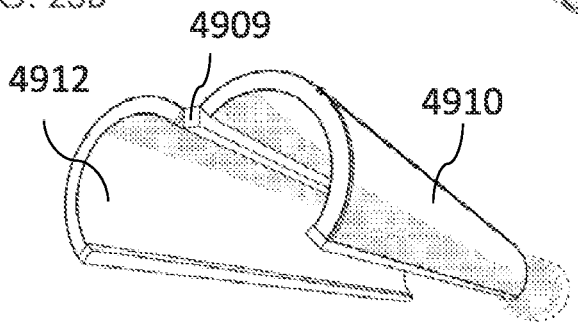
Figure 25D:
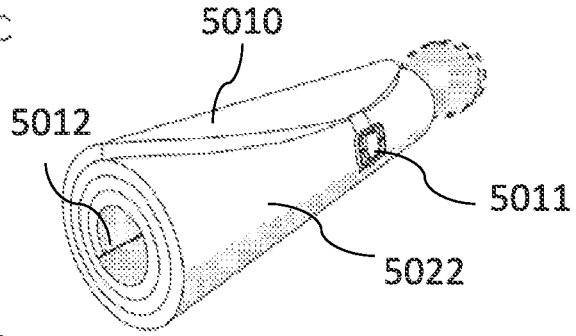

Turning now to FIGS. 25A-C, exemplary embodiments of the access points of a bag module, in accordance with embodiments of the present invention are shown. As shown in FIG. 25A, the access point 4712 formed in an end point 4732 of a bag module 4720. In one embodiment, the access point 4712 may be closed off by an endcap 4733 that connects to the bag module 4720 via corresponding bag module connectors 4714. As shown in FIG. 25B, the access point 4812 may be formed in the side wall of the bag module 4810 with access door 4815 that is secured to the bag module 4810 with an access point securing device 4811. As shown in FIG. 25C, the access point may also be provided by a longitudinal body hinge that enables the bag module 4910 to be opened to provide an access point 4912 along the entirety of the length of the bag module 4910. As shown in FIG. 25D, a bag module 5010 may be formed from a module wall sheet 5022 that is rolled-up to form a substantially tubular bag module 5010. In one embodiment, the substantially tubular bag module 5010 may not include any formal access point 5012 and instead access to the interior of the tubular bag module 5010 will be provided by unrolling the module wall sheet 5022 where storage is provided for on the inner surface of the module wall sheet 5022. In another embodiment the substantially tubular bag module 5010 may include an access point 5012 at either end of the bag module 5010. The substantially tubular bag module 5010 may further comprise an access point securing device 5011 that secures the module wall sheet 5022 in a rolled configuration.

Figure 26A:
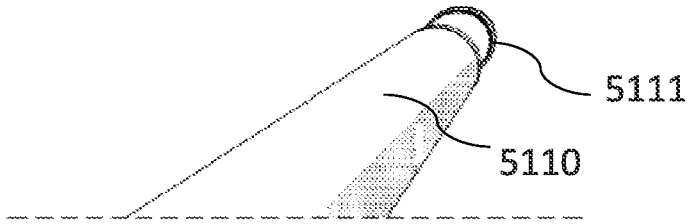
FIGS. 26A-C illustrates various access point securing devices, in accordance with an embodiment of the present invention.
Figure 26B:
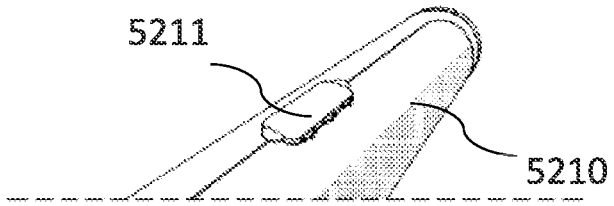
Figure 26C:
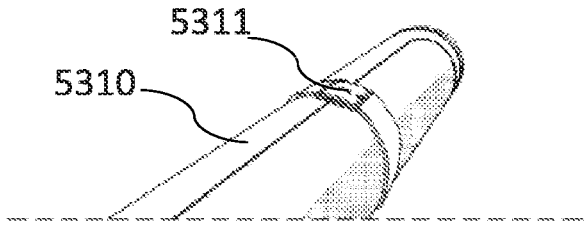

Turning now to FIGS. 26A-C, exemplary embodiments of the access point securing device of a bag module, in accordance with embodiments of the present invention. As shown in FIG. 25A, the access point securing device 5111 is an endcap. As shown in FIG. 25B, the access point securing device 5211 is a locking mechanism. As shown in FIG. 25C, the access point securing device 5311 is a buckle strap.

Figure 27:
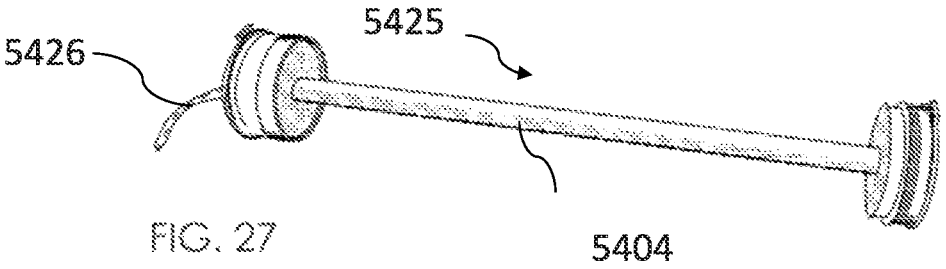
FIG. 27 is a perspective view of a garment rolling device consisting primarily of a garment rolling guide bar, in accordance with an embodiment of the present invention.
Figure 28:
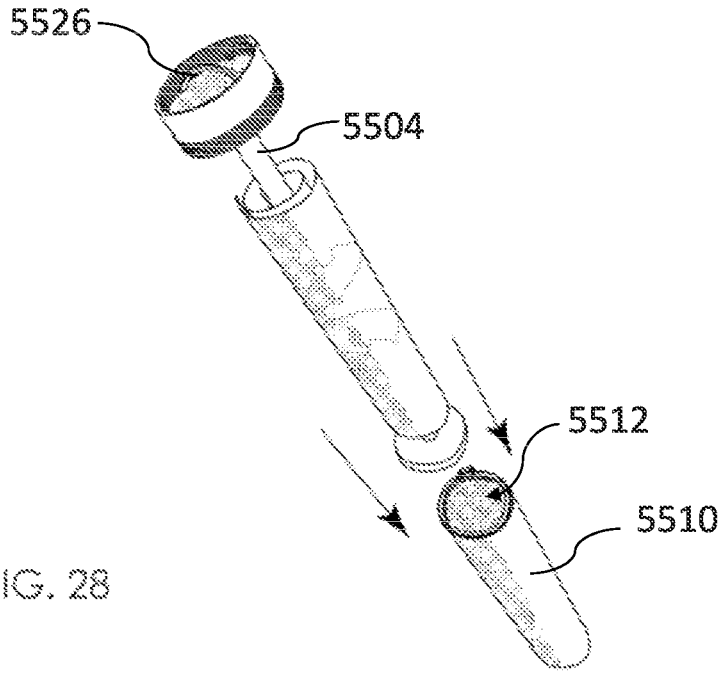
FIG. 28 is an illustration of the garment rolling device of FIG. 27 being inserted into a bag module at an access point, in accordance with an embodiment of the present invention.

Turning now to FIGS. 27 and 28, an exemplary embodiment of a garment rolling device, in accordance with an embodiment of the present invention. In one embodiment, a bag module 5510 may be configured to receive a garment rolling device 5504 via an access point 5512 on the end of the bag module. In this embodiment, the garment rolling device 5404 may consist primarily of a garment rolling guide bar 5404. In one embodiment, the garment rolling device 5404 may include a pull-push strap or handle 5426 to help a user pull the garment rolling device 5404 out of or insert the garment rolling device 5404 into a bag module. In one embodiment the garment rolling guide bar 5504 may be fully extractable from the bag module 5510. In another embodiment, the garment rolling guide bar 5504 may only partially extractable from the bag module 5510, with at least a portion of the garment rolling guide remaining inside the bag module.

Figure 29:
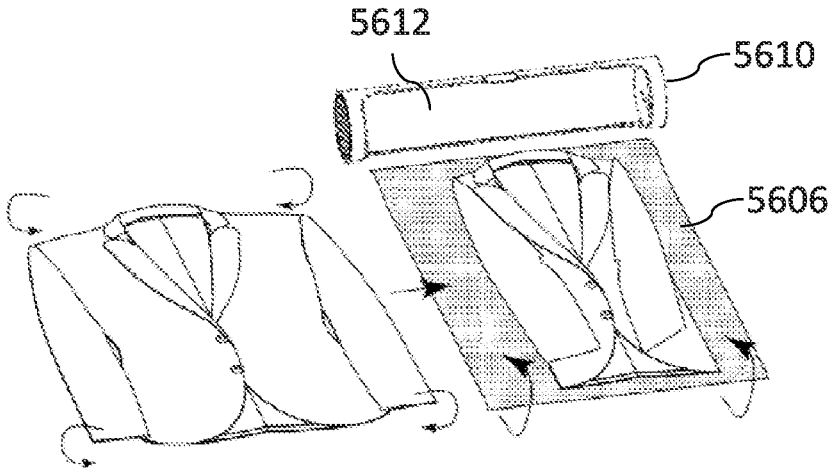
FIG. 29 is an illustration of a garment rolling device consisting primarily of a garment rolling sheet, in accordance with an embodiment of the present invention.

Turning now to FIG. 29, an exemplary embodiment of a garment rolling device configured as a garment rolling sheet, in accordance with an embodiment of the present invention. In one embodiment, the garment rolling device may be a garment rolling sheet 5606. In this embodiment, a garment would be placed on the garment rolling sheet 5606, which would then be rolled-up and placed inside of a bag module 5610 via an access point 5612.

Figure 30:
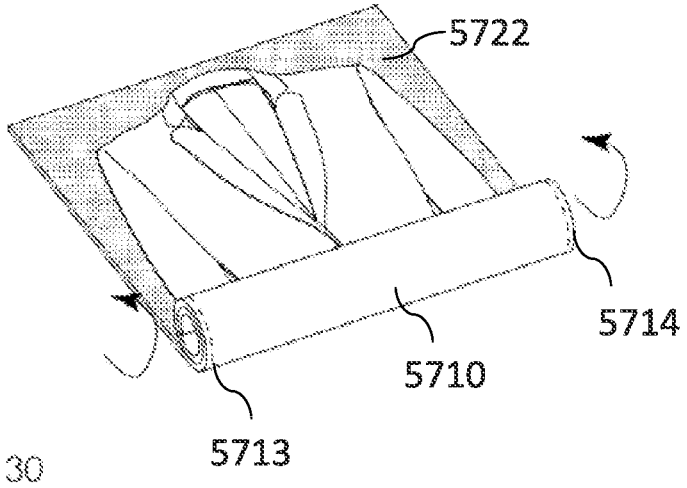
FIG. 30 is an illustration of a tubular bag module formed from a rolled sheet of material, in accordance with an embodiment of the present invention.

Turning now to FIG. 30, an exemplary embodiment of a garment bag module formed from a one or more sheets of material. In one embodiment, a bag module may be formed by rolling one or more module wall sheets 5722 to form a substantially tubular bag module 5710.

Turning now to FIGS. 31A-D, an exemplary embodiment of a garment rolling device configured as a garment rolling sheet, in accordance with an embodiment of the present invention. In one embodiment, the garment rolling device may be a garment rolling sheet 5606 that is shaped to receive a blazer or suit jacket. In some embodiments, the garment rolling sheet 5606 may also include a slot 5838 that is configured to receive a pair of pants. In this embodiment, garments would be placed around the garment rolling sheet 5606, which would then be rolled-up and placed inside of a bag module 5810 via an access point 5812.

Figure 32:
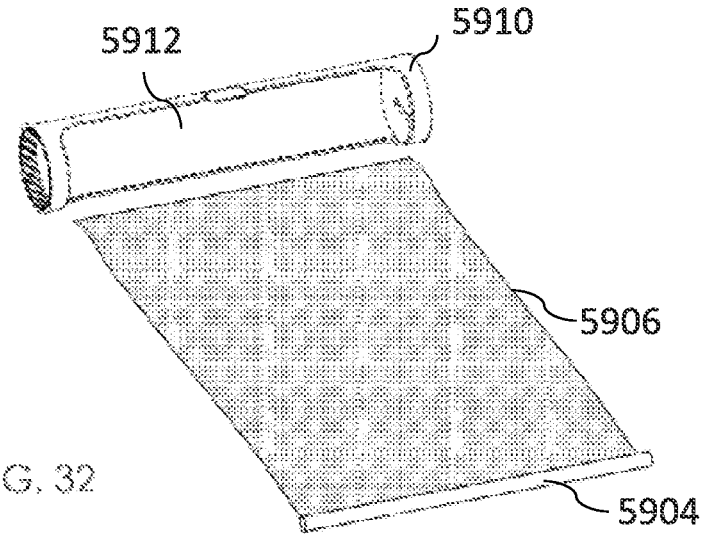
FIG. 32 is an illustration of a garment rolling sheet with two garment rolling guide bars, in accordance with an embodiment of the present invention.
Figure 33:
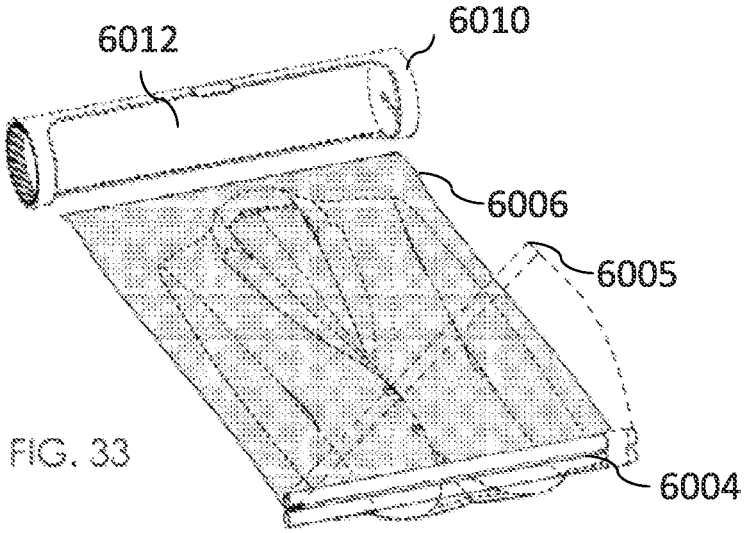
FIG. 33 is an illustration of a garment rolling sheet with two bars creating a clipping devise as a rolling guide, in accordance with an embodiment of the present invention.

Turning now to FIGS. 32 and 33, an exemplary embodiment of a garment rolling device with both a garment rolling sheet and a garment rolling guide bar, in accordance with embodiments of the present invention. As shown in FIG. 32, the garment rolling sheet 5906 may be attached to a garment rolling guide bar 5904 to assist a user in evenly rolling-up the garment rolling sheet 5906. As shown in FIG. 33, the garment rolling sheet 6006 may be configured with two garment rolling guide bars 6004 and 6005 that a garment can be held between while the garment rolling sheet 6006 is rolled-up. In this embodiment, the garment rolling guide bars 6004 and 6005 may cooperate to create a clipping effect whereby a garment can be secured between the garment rolling guide bars 6004 and 6005. As shown in FIG. 33, a first garment rolling guide bar 6005 could be separated and pivoted away from a second garment rolling guide bar 6004 to permit a garment to be secured between the garment rolling guide bars 6004 and 6005. Once the garment has been placed on the garment rolling sheet 6006 and over the first the garment rolling guide bar 6004, the second garment rolling guide bar 6005 can be closed on top of the garment, securing it on the garment rolling sheet 6006. In this embodiment, the garment rolling guide bars 6004 and 6005 also function to help initiate the rolling process, as the clipping effect created between the garment rolling guide bars 6004 and 6005 keeps the garment from moving during the rolling process.

Turning now to FIGS. 34A-C, an exemplary embodiment of hanger element on a garment rolling sheet, in accordance with an embodiment of the present invention. As shown in FIGS. 34A-C, a garment and garment rolling sheet 6106, may also be attached to a hanger element 6129. In some embodiments, the garment rolling sheet may also include a hook-and-loop strip 6137 or a tie-string that is attached to the garment rolling sheet 6106 and used to secure the garment rolling sheet 6106 in a rolled-up configuration as in FIG. 34C. In one embodiment, the hanger element comprises a first hanger bar, a second hanger bar, and a hook as described in more detail below in relation to FIG. 37. In one embodiment, the hanger element 122 may include embedded clips that attach to the garment rolling sheet 116. One of ordinary skill in the art would appreciate that the hanger element shown in FIGS. 34A-C could also function as a garment rolling device.

Turning now to FIG. 35, an exemplary embodiment of a garment rolling device, in accordance with an embodiment of the present invention. In one embodiment of the present invention, a garment rolling device 6206 may comprise a garment rolling guide bar 6204 attached to a garment rolling sheet 6206 to assist the user in rolling-up a garment on the garment rolling sheet 6206. As shown in FIG. 35, a second garment rolling guide bar 6205 could be separated and pivoted away from a first garment rolling guide bar 6204 to permit a garment to be secured between the garment rolling guide bars 6204 and 6205. Once the garment has been placed on the garment rolling sheet 6206 and over the first the garment rolling guide bar 6204, the second garment rolling guide bar 6205 can be closed on top of the garment, securing it on the garment rolling sheet 6206. In this embodiment, the garment rolling guide bars 6204 and 6205 also function to help initiate the rolling process, as the clipping effect created between the garment rolling guide bars 6204 and 6205 keeps the garment from moving during the rolling process. In some embodiments, the garment rolling device 6225 may also include a hook-and-loop strip 6237 or a tie-string that is attached to the garment rolling sheet 6206 and used to secure the garment rolling device 6225 in a rolled-up configuration. Additionally, the garment rolling device 6225 may include lateral tabs at the ends of each side of the garment rolling sheet 6206, which are connected to garment rolling bars 6204 and 6205 at that end of the sheet. In this embodiment, the tabs are used to provide end-walls that close-off the otherwise open end points of a bag module. In some embodiments, these lateral tabs may include a pull strap or handle, as shown by component 5426 in FIG. 27, to help a user pull the garment rolling device 5425 out of or insert the garment rolling device 5425 into a bag module.

Figure 36:
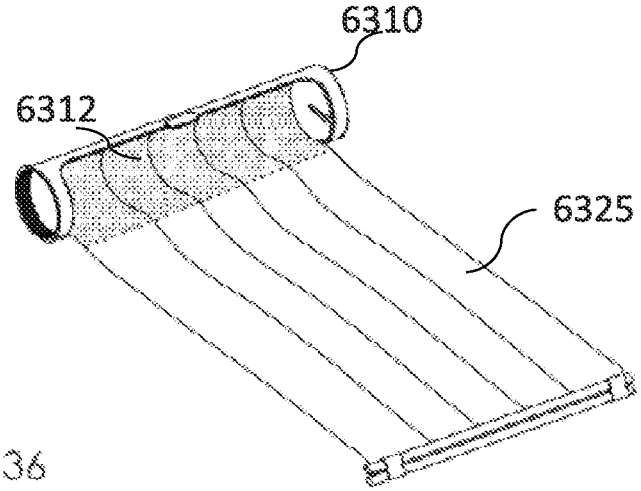
FIG. 36 is an illustration of a garment rolling device connected to a bag module, in accordance with an embodiment of the present invention.

Turning now to FIG. 36, an exemplary embodiment of a garment rolling device attached to a bag module, in accordance with an embodiment of the present invention. In one embodiment, a garment rolling device 6325 may be attached directly at an access point 6312 of a bag module 6310. In some embodiments, the garment rolling device 6325 may be permanently attached to the bag module 6310 and in others it may be reversibly attached to the bag module 6310.

Figure 37:
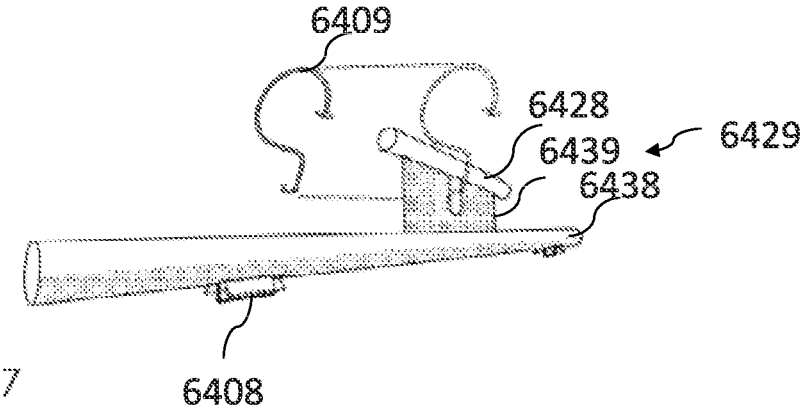
FIG. 37 is an illustration of a hanger element on a garment rolling guide bar, in accordance with an embodiment of the present invention.

Turning now to FIG. 37, an exemplary embodiment of a hanger element configured as a hanger bar, in accordance with an embodiment of the present invention. In one embodiment, the hanger element 6429 comprises a hook 6409, a first hanger bar 6438, and a second hanger bar 6428. In this embodiment, the first hanger bar 6438 may be a rigid, semi-rigid, or bendable bar that has the length of a traditional hanger. The first hanger bar 6438 may include clips 6408 that are embedded in the first hanger bar 6438. These clips 6408 can be used to clip pants to the hanger element 6429 or be used to clip onto an unconnected garment rolling sheet, as shown in FIGS. 34A-C, thereby allowing the combination of the first hanger bar 6438 and second hanger bar 6428 to function as a combined garment rolling guide bar. In this embodiment, the second hanger bar 6428 may be a rigid, semi-rigid, or flexible bar that is shorter than and connected to the first hanger bar 6438 by a connector sheet 6439. The second hanger bar 6428 may be configured to align near the collar of a blazer, as shown in FIG. 34B, thereby providing resistance and strength to the blazer before rolling and further minimizing wrinkles to the garment. In this embodiment, the hook 6409 attaches to the second hanger bar 6428 to permit the hanger element 6429 to be suspended in a closet or on a hook of a coat rack. The hook 6409 is preferably removable, so as to allow an easier rolling process and to prevent any possible damage to the garment by the hook.

Figure 38:
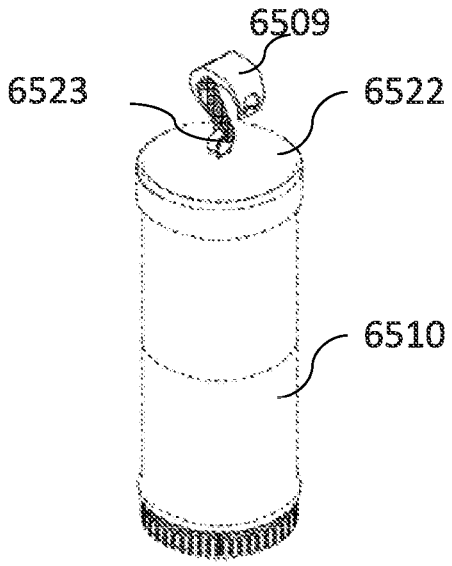
FIG. 38 is an illustration of a hanger element on an endcap of a bag module, in accordance with an embodiment of the present invention.
Figure 39:
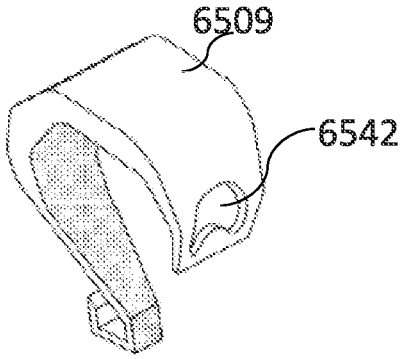
FIG. 39 is an illustration of a hanger element with a bottle opener, in accordance with an embodiment of the present invention

Turning now to FIGS. 38 and 39, an exemplary embodiment of a hanger element attached to a bag module, in accordance with an embodiment of the present invention. As shown in FIG. 38, a hanger element 6509 may be attached to an endcap 6522 of a bag module 6510 via an accessory attachment point 6523. As shown in FIG. 39, the hanger element 6509 could include a bottle opener 6542.

According to an embodiment of the present invention, and in conjunction with embodiments of the multi-purpose modular travel container described herein, a method for rolling and storing articles of clothing in a multi-purpose modular travel container is provided. Turning to FIG. 40, an exemplary method for rolling and storing articles of clothing in a multi-purpose modular travel container is shown. The process starts at step 200 with a multi-purpose modular travel container and an article of clothing to be rolled and stored within the multi-purpose modular travel container.

At step 202, a garment rolling sheet of the multi-purpose modular travel container is laid flat and prepared for receipt of the article of clothing. While in one embodiment, the garment rolling sheet is lain flat, one of ordinary skill in the art would appreciate that the garment rolling sheet may not need to be laid completely flat and may be lain substantially flattened or some other semblance of flat. The important feature is that the garment rolling sheet be extended such that the article of clothing can be received thereupon.

At step 204, the article of clothing is laid flat on the garment rolling sheet. In some embodiments of the present invention, the garment rolling sheet may be matched or otherwise formed to fit with the particular article of clothing. For instance, a garment rolling sheet formed to receive articles of clothing, such as pants, can be substantially formed in a pant-like form (See, FIG. 41A). Similarly, an article of clothing, such as a suit jacket, can utilize a garment rolling sheet formed in a suit jacket form (See, FIG. 41B).

After the article of clothing is lain on the garment rolling sheet, two optional steps may occur, either alone or in conjunction with another. First, at optional step 205, the article of clothing may be secured to the garment rolling sheet in order to prevent the article of clothing from slipping off, moving, or otherwise being separated from the garment rolling sheet during the rolling process. Attaching the article of clothing to the garment rolling sheet can be done in accordance with the elements described elsewhere herein.

At optional step 207, a rolling guide can be secured to the garment rolling sheet for use in ensuring the article of clothing is rolled appropriately during the rolling process. The rolling guide can be attached and utilized as described elsewhere herein (See, FIGS. 33-35).

At step 208, whether the previously described optional steps occur or not, the article of clothing and garment rolling sheet are rolled into a tight and well fit roll, preventing wrinkles and other deformations of the article of clothing, as described elsewhere herein. At step 210, the rolled article of clothing and garment rolling sheet are inserted into the bag module of the multi-purpose modular travel container (See, FIG. 42A). The multi-purpose modular travel container may also be locked or otherwise sealed at this point to further protect the article of clothing (See, FIG. 42B). At this point, the process ends at step 212.

Figure 41A:
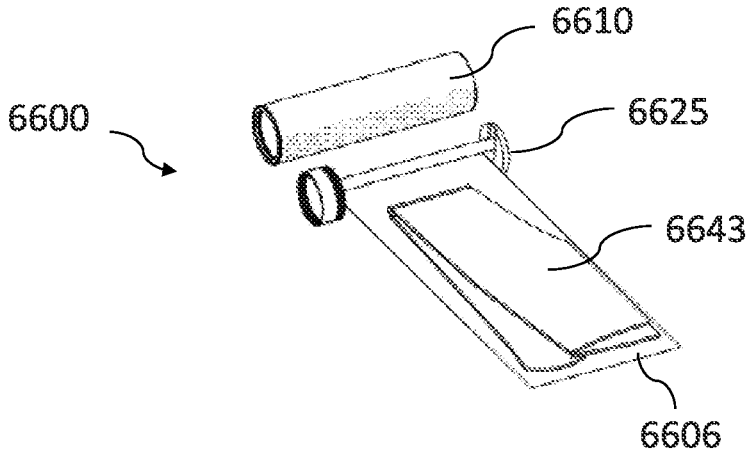
FIGS. 41A and B are illustrations of a suit jacket and suit pants being packaged in separate bag module, in accordance with an embodiment of the present invention.
Figure 41B:
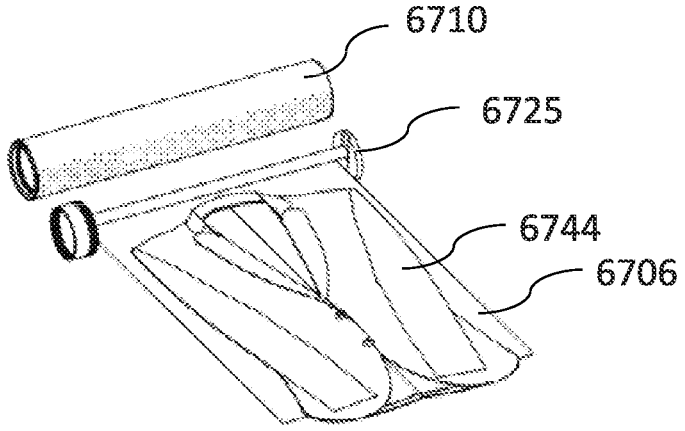

Turning now to FIGS. 41A and B, exemplary embodiments of a bag module configured as retail packaging in accordance with embodiments of the present invention. In one embodiment, a suit jacket 6744 or suit pants 6643 may be placed on a garment rolling sheet 6706 or 6606 of a garment rolling device 6725 or 6625, so that the suit jacket 6744 or suit pants 6643 can be rolled-up and placed inside of a bag module 6710 or 6610.

Figure 42A:
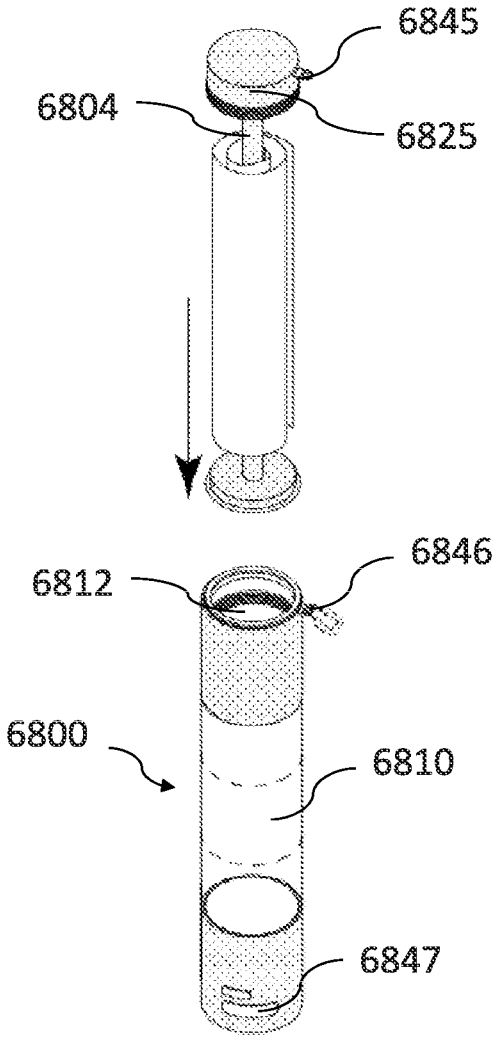
FIGS. 42A and B are illustrations of a bag module as retail packing, in accordance with an embodiment of the present invention.
Figure 42B:
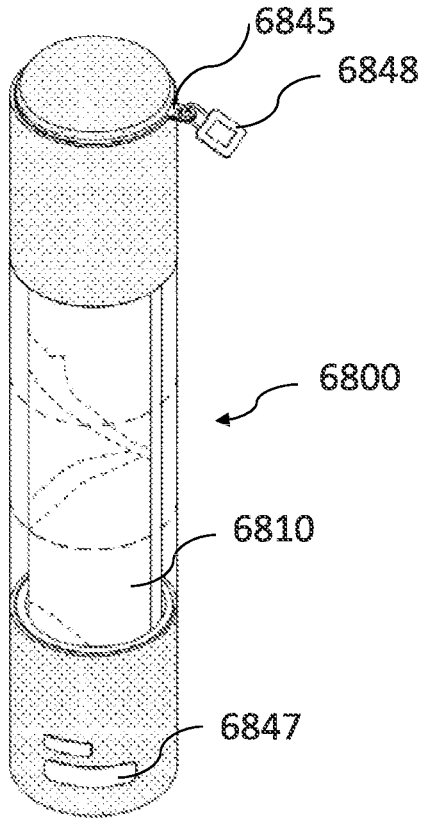

Turning now to FIGS. 42A and B, an exemplary embodiment of a bag module configured as retail packing in accordance with an embodiment of the present invention. In one embodiment, the bag module 6800 may primarily comprise a roller 6825 that is placed inside of the bag module 6800. In this embodiment, a rolling guide bar 6804 on the roller 6825 can be used to roll-up an item. The roller 6825 is then inserted into the bag module 6800 via an access point 6812 on the bag module 102. In some embodiments, the bag module 6800 may include a lock 6848 that is inserted through a locking point 6846. In some embodiments, the bag module may also include a labeling component 6847.

Figure 43A:
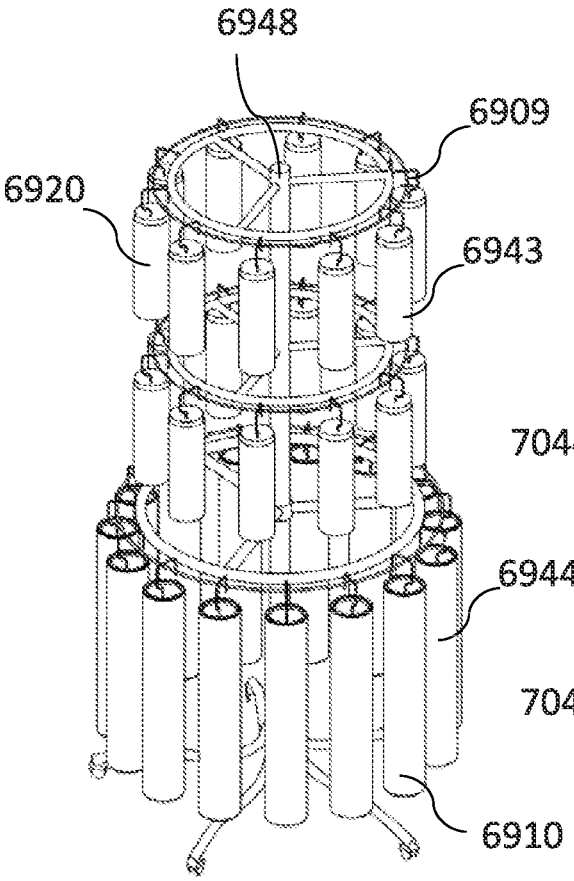
FIGS. 43A and B are illustrations of the bag modules in FIGS. 41A and B displayed on a clothing rack, in accordance with an embodiment of the present invention.
Figure 43B:
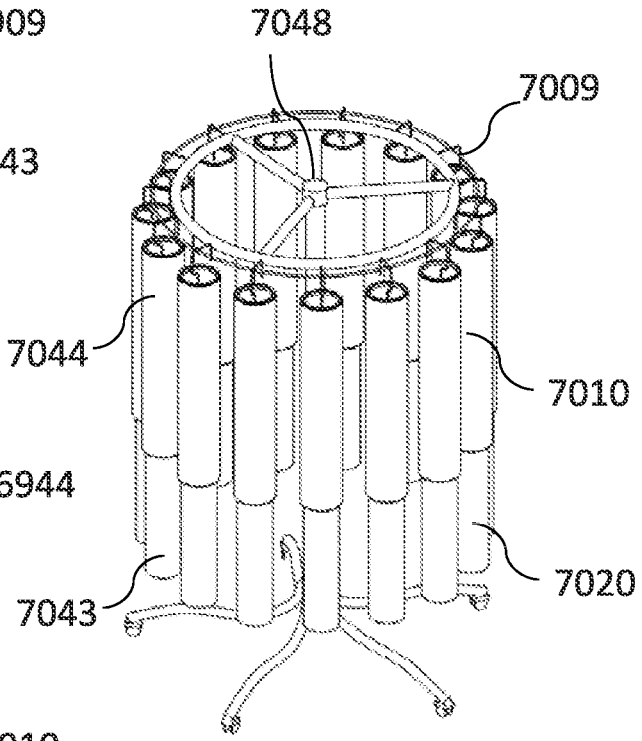

Turning now to FIGS. 43A and B, exemplary embodiments of bag modules that are configured to hang from a retail rack in accordance with embodiments of the present invention. In one embodiment, the bag modules 6910 and 6920, or 7010 and 7020, may be configured to hang from a clothing rack 6948 or 7048 through the use of hook 6909 or 7009. In one embodiment, each of the suit jacket bag modules may hang on the clothing rack 152 separately from each of the suit pant bag modules. This arrangement could allow a consumer to select a separate suit jacket module and suit pant module that could be connected together. In an alternate embodiment, each suit jacket bag module may be connected to a suit pant bag module when placed on the clothing rack.

Figure 44:
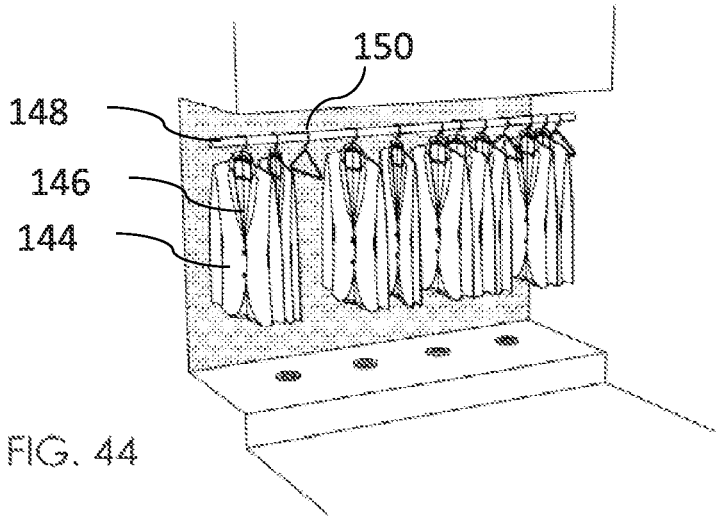
FIG. 44 is an illustration of a traditional display for selling a suit, in accordance with an embodiment of the present invention.
Figure 45:
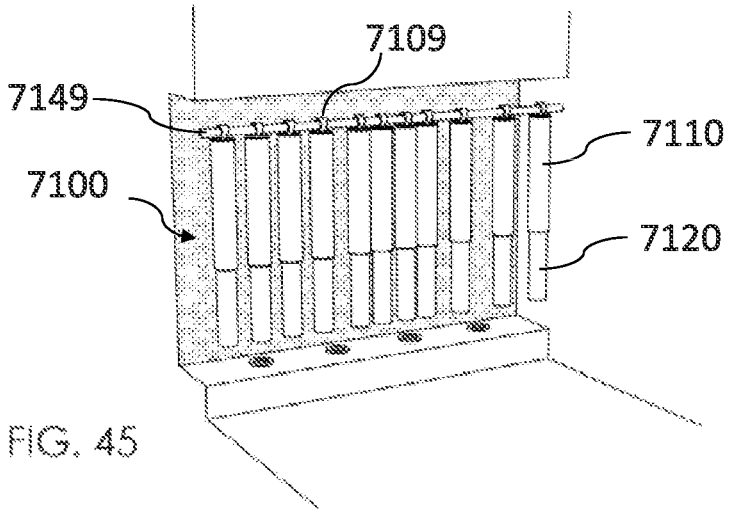
FIG. 45 is an illustration of a display for selling a suit in the modular packaging of FIGS. 41A and B, in accordance with an embodiment of the present invention.

Turning now to FIGS. 44 and 45, exemplary illustrations of retail suit displays, in accordance with an embodiment of the present invention. Traditionally, as shown in FIG. 44, suit jackets 144 and suit pants 146 are sold in a retail setting by hanging the suit jackets 144 and suit pants 146 on a hanger 150 that is placed on a hanger bar 148. In one embodiment of the present invention, suit jackets and suit pants may be sold in a retail setting by placing the suit jacket and suit pants in separate bag modules 7110 and 7120 that are connected together to form a single modular package 7100 that may be hung from a hanger bar 7149 using a hook 7109.

Each element in flowchart illustrations may depict a step, or group of steps, of one embodiment of the methods described herein. Further, each step may contain one or more sub-steps. For the purpose of illustration, these steps (as well as any and all other steps identified and described above) are presented in order. It will be understood that an embodiment can contain an alternate order of the steps adapted to a particular application of a technique disclosed herein. All such variations and modifications are intended to fall within the scope of this disclosure. The depiction and description of steps in any particular order is not intended to exclude embodiments having the steps in a different order, unless required by a particular application, explicitly stated, or otherwise clear from the context.

While multiple embodiments are disclosed, still other embodiments of the present invention will become apparent to those skilled in the art from this detailed description. There may be aspects of this invention that may be practiced without the implementation of some features as they are described. It should be understood that some details have not been described in detail in order to not unnecessarily obscure focus of the invention. The invention is capable of myriad modifications in various obvious aspects, all without departing from the spirit and scope of the present invention. Accordingly, the drawings and descriptions are to be regarded as illustrative in nature and not restrictive.

What is claimed is:

1. A method for packaging, holding, or displaying one or more articles of clothing, the system comprising:

providing a container comprising:

a shell with at least one side wall made of a rigid or semi-rigid material, an axis defined by a first endpoint at one end of said shell and by a second endpoint at an opposite end of said shell, a storage cavity formed inside of said shell, one or more opening that provides access to said storage cavity;

a locking mechanism that secures the access to said storage cavity;

a hook;

a garment rolling device that comprises a rolling guide bar, an endcap located at the end of said rolling guide bar, and a rolling sheet, wherein at least one article of clothing is placed to be folded or rolled in a substantially wrinkle-resistance manner;

wherein said storage cavity is configured to receive said garment rolling device;

wherein said locking mechanism that secures the access to said storage cavity is a cap located at said first end point of said shell;

wherein, when the garment rolling device is inserted into said storage cavity, the endcap of said garment rolling device functions as said cap of said locking mechanism; and wherein said shell has a shape selected from a group of shapes consisting of circular, oval, elliptical, triangular, rectangular, hexagonal, and any combination thereof;

placing said rolling sheet in a flat configuration, prepared for receipt of said article of clothing;

laying flat said article of clothing on said rolling sheet;

rolling said article of clothing and said rolling sheet into a tight and well fit roll, preventing wrinkles and other deformations of said article of clothing;

inserting said rolled article of clothing and said garment rolling device into the storage cavity formed inside of the shell of said container;

locking or sealing said access point that provides access to said storage cavity of said container, to further protect the article of clothing stored inside; and hanging said sealed container from a rack from said hook.

2. The method of claim 1, wherein the container further comprises a secondary module comprising a storage cavity and a second module connector;

wherein said shell is a first module that further comprises a primary axis and a first module connector;

wherein a detachable connection between said first module connector and said second module connector will cause said first module and said secondary module to be stacked side-by-side, atop of each other, or in an end-to-end configuration;

wherein each of the first module and the secondary module is capable of functioning independently.

3. The method of claim 2, wherein the secondary module is able to be detached from said first module without need to access to said storage cavity of said first module.

4. The method of claim 2, wherein the size of said secondary module is different than the size of said first module.

5. The method of claim 2, wherein said detachable connection is an indirect connection formed by a linking connector.

6. The method of claim 2, wherein said detachable connection is formed by securely abutting said secondary module against said first module such that the secondary module is extensive with the primary axis of the first module.

7. The method of claim 2, further comprising:

placing any article inside said storage cavity of said secondary module; and hanging said secondary module from a rack.

8. The method of claim 2, further comprising:

placing any article inside said storage cavity of said secondary module; and attaching said secondary module to said first module.

9. The method of claim 2, wherein said first module and said secondary module are detachable by a securing element that is an external securing element separate from said first module or said secondary module.

10. The method of claim 1, wherein said locking mechanism is at least one of a biometric lock, a digital, electronic, or a magnetic lock.

11. The method of claim 1, wherein said locking mechanism is at least one of a buckle, a zipper, or straps.

12. The method of claim 1, wherein the container further comprises one or more accessories selected from the group of accessories consisting of carrying elements, and wheels; and wherein said one or more accessories is removable from the container.

13. The method of claim 1, wherein said endcap of said garment rolling device comprises a handle on the outer portion of said endcap to allow said garment rolling device to be pulled out of and pushed into said storage cavity formed inside of said shell.

14. The method of claim 1, wherein said hook is removable and is attached to an accessory attachment point located on said shell.

15. The method of claim 1, wherein said garment rolling device comprises a hanger element that comprises a first hanger bar, a second hanger bar, and said hook.

16. The method of claim 1, wherein said rolling sheet of said garment rolling device comprises a plurality of bending lines arranged perpendicularly to the primary rolling direction.

* * * * *